US010538048B2

(12) United States Patent
Noguchi et al.

(10) Patent No.: US 10,538,048 B2
(45) Date of Patent: Jan. 21, 2020

(54) ELECTRIC PRESS AND METHOD FOR CALIBRATING THE SAME

(71) Applicant: JANOME SEWING MACHINE CO., LTD., Hachioji-shi, Tokyo (JP)

(72) Inventors: Tadahiro Noguchi, Hachioji (JP); Jun Nishizawa, Hachioji (JP); Tadashi Matsushita, Hachioji (JP); Kenichiro Hiruma, Hachioji (JP)

(73) Assignee: JANOME SEWING MACHINE CO., LTD., Hachioji-shi, Tokyo (JP)

( * ) Notice: Subject to any disclaimer, the term of this patent is extended or adjusted under 35 U.S.C. 154(b) by 351 days.

(21) Appl. No.: 15/438,759

(22) Filed: Feb. 22, 2017

(65) Prior Publication Data

US 2017/0259516 A1 Sep. 14, 2017

(30) Foreign Application Priority Data

Mar. 9, 2016 (JP) ..... 2016-045871

(51) Int. Cl.
*B30B 1/18* (2006.01)
*B30B 15/00* (2006.01)

(52) U.S. Cl.
CPC ..... *B30B 1/186* (2013.01); *B30B 15/0094* (2013.01)

(58) Field of Classification Search
CPC ..... B30B 15/0094; B30B 1/186; B30B 15/14; B30B 15/285; B30B 15/288; B30B 1/181
See application file for complete search history.

(56) References Cited

U.S. PATENT DOCUMENTS

2005/0081587 A1* 4/2005 Suzuki ..... B30B 15/26 72/20.1
2009/0025444 A1* 1/2009 Suzuki ..... B21D 24/02 72/16.1
2011/0232065 A1* 9/2011 Hill, Jr. ..... B23P 11/00 29/428

FOREIGN PATENT DOCUMENTS

| | | | |
|---|---|---|---|
| JP | S59-212200 | A | 12/1984 |
| JP | 2002-292499 | A | 10/2002 |
| JP | 4150243 | B | 9/2008 |
| KR | 2001-0021097 | A | 3/2001 |
| KR | 10-0712973 | B | 4/2007 |

* cited by examiner

*Primary Examiner* — Jimmy T Nguyen
(74) *Attorney, Agent, or Firm* — Yokoi & Co., U.S.A.; Tushiyuki Yokoi

(57) ABSTRACT

Disclosed herein are an electric press and a method for calibrating the electric press, which can implement a rapid calibration operation. An electric press (10) includes a ram location information storage unit (63) and a load control unit (64). The ram location information storage unit (63) stores ram location information, corresponding to actual load values and representing locations to which a ram is moved, in advance. The load control unit (64) applies an actual load, corresponding to at least one location which belongs to the locations represented by the ram location information and to which the ram is moved, to a compression target by moving the ram to the location. Accordingly, the load value output by the detection unit is calibrated based on the actual load value applied to the compression target.

5 Claims, 16 Drawing Sheets

ELECTRIC PRESS AND METHOD FOR CALIBRATING THE SAME

CROSS-REFERENCES TO RELATED APPLICATIONS

This patent specification is based on Japanese patent application, No. 2016-045871 filed on Mar. 9, 2016 in the Japan Patent Office, the entire contents of which are incorporated by reference herein.

BACKGROUND OF THE INVENTION

1. Field of the Invention

The present invention relates to an electric press and a method for calibrating the electric press.

2. Description of the Related Art

An electric press performs machining, such as indentation, compression or the like, on a workpiece by driving a ram by using an electric motor as a power source. A strain column to which a load cell is adhered is mounted on the front end of the ram. The electric press detects a load value applied to the workpiece from the output value of the load cell, and controls the driving of the ram while comparing the detected load value with a desired load value to be applied to the workpiece.

The electric press includes an instrumentation amplifier and an analog-to-digital (A/D) converter. Furthermore, the electric press includes a conversion table between amplified values and load values that is used in the control of the ram. That is, the electric press detects the corresponding load value by amplifying the output of the load cell, converting the output into a digital value and then converting the digital value into the load value. Generally, the reason why the electric press includes the instrumentation amplifier is that an analog signal output by load cell is weak. Furthermore, the reason why the electric press includes the conversion table is that amplified values are not consistent with load values due to nonlinearity among gain and offset values set for the instrumentation amplifier, the output values of the load cell, and actual load values. In the following description, a load actually applied to a compression target, such as a workpiece or the like, is referred to as an "actual load," and a value used in the control of the ram through conversion by the load cell, the instrumentation amplifier, the A/D converter, or the conversion table is referred to as a "load value."

When the electric press is installed in a factory, a calibration operation is performed. During the calibration operation, a reference load cell is used as a compression target in placed of the workpiece W, and output values on an electric press side are compared with the output values of the reference load cell for various loads while the loads are being applied to the reference load cell. Furthermore, the gain value, offset value and conversion table of the instrumentation amplifier are adjusted.

FIG. 19 is a graph plotting changes in the output value of the load cell over time under the same load. A correlation between the output value of the load cell and the load changes over time. The hardening of a bonding agent used to adhere the load cell to the strain column is viewed as one reason for the changes. Accordingly, it is desirable that the calibration operation of the electric press is periodically performed after the installation of the electric press. During the calibration operation, it is recommended that the reference load cell to which loads are applied is loaded on a die set spring. The die set spring functions to absorb a load, and can prevent an excessive load from spreading to the electric press and a facility, on which the electric press is mounted, even when the ram overshoots.

However, once the electric press has been installed in a factory, there occurs a case where it is difficult to install a die set spring due to a difference in the size of workpiece and the stroke of the die set spring. When the ram overshoots excessively in without a die set spring, a load must be absorbed by the stiffness of the electric press or facility. When the stiffness of the electric press or facility is represented by a spring coefficient, the spring coefficient is considerably greater than that of the die set spring. Accordingly, the great overshoot of the ram that occurs due to the absence of the die set spring may cause damage to the electric press and the facility.

Conventionally, when it is difficult to install a die set spring during a calibration operation performed to deal with a change in the load cell over time, the ram must be moved at low speed in order to reduce an overshoot to a considerably small value. The reason for this is that the quantity of an overshoot is proportional to the speed of the ram. Alternatively, the calibration operation must be performed after the electric press or instrumentation amplifier has been removed from the facility.

The calibration operation requiring the low speed movement of the ram and the calibration operation requiring the removal of the electric press or instrumentation amplifier take excessively long periods of time. During the calibration operation, the operation of the facility is stopped. Accordingly, when the calibration operation takes an excessively long period of time, a reduction in the manufacturing efficiency of workpiece becomes serious.

It may be contemplated that measures are taken to suppress a reduction in manufacturing efficiency by somewhat increasing the intervals at which the calibration operation is performed. However, when the output value of the instrumentation amplifier deviates from the A/D convertible range of the A/D converter due to a change in the load cell over time, the output value of the A/D converter is saturated and thus an appropriate load cannot be applied to a workpiece. Furthermore, even when an excessive load above a rated load is applied to the electric press, it is difficult to identify the excessive load, resulting in damage to the electric press.

To prevent the clipping of the A/D converter, the multiplication factor of the instrumentation amplifier must be set to a small value, i.e., a gain value must be set to a small value, in order to prepare for a change in the load cell over time. As a result, the resolution of the load value is degraded, and thus the electric press cannot offer its inherent performance.

PRECEDING TECHNICAL DOCUMENT

Patent Document

Patent document 1: Japanese Patent No. 4150243

BRIEF SUMMARY OF THE INVENTION

The present invention is proposed to overcome the problems of the conventional technology, and an object of the present invention is to provide an electric press and a method for calibrating the electric press, which can prevent a great overshoot from occurring even when a ram is moved at high speed and which can implement a rapid calibration operation.

In order to achieve the object of the present invention, there is provided a method for calibrating an electric press, the electric press including a detection unit configured to detect a load value applied to a compression target and electrically driving a ram based on the load value, the method including: storing ram location information, corresponding to actual load values and representing locations to which the ram is moved, in advance; applying an actual load, corresponding to at least one location which belongs to the locations represented by the ram location information and to which the ram is moved, to the compression target by moving the ram to the location; and calibrating the load value, output by the detection unit, based on the actual load value applied to the compression target.

The detection unit may include a load cell and an instrumentation amplifier and detect the load value through a process of amplifying the output value of the load cell by means of the instrumentation amplifier, and the calibrating may include changing the gain and offset values of the instrumentation amplifier.

The detection unit may include a load cell, an instrumentation amplifier, and a load value generation unit having a conversion table representing correlations between amplified values of the instrumentation amplifier and load values and detect the load value through a conversion process of converting an amplified value, output by the instrumentation amplifier, into the load value, and the calibration may include changing the values or correlations of the conversion table.

During the calibration or during the machining of the compression target, a correlation between the amplified value and the load value absent in the conversion table may be generated by interpolation based on the correlations between the amplified values and the load values present in the conversion table.

Additionally, in order to achieve the object of the present invention, there is provided an electric press for applying a load to a compression target by means of an electrically-driven ram, the electric press including: a detection unit configured to detect a load value applied to the compression target; and a control unit configured to control the ram based on the load value of the detection unit and calibrate the load value; wherein the control unit configured to calibrate the load value includes: a ram location information storage unit configured to store ram location information, corresponding to actual load values and representing locations to which the ram is moved, in advance; and a load control unit configured to apply an actual load, corresponding to at least one location which belongs to the locations represented by the ram location information and to which the ram is moved, to the compression target by moving the ram to the location; and wherein the control unit configured to calibrate the load value calibrates the load value, output by the detection unit, based on the actual load value applied to the compression target.

The detection unit may include a load cell and an instrumentation amplifier and detect the load value through a process of amplifying the output value of the load cell by means of the instrumentation amplifier, and the control unit may change the gain and offset values of the instrumentation amplifier.

The detection unit may include a load cell, an instrumentation amplifier, and a load value generation unit having a conversion table representing correlations between amplified values of the instrumentation amplifier and load values and detect the load value through a conversion process of converting an amplified value, output by the instrumentation amplifier, into the load value, and the control unit may change the values or correlations of the conversion table.

During the calibration or during the machining of the compression target, the control unit may generate a correlation between the amplified value and the load value absent in the conversion table through interpolation based on the correlations between the amplified values and the load values present in the conversion table.

The detection unit may include: a strain element configured to come into contact with the compression target; a load cell configured to detect the distortion of the strain element; an instrumentation amplifier installed inside the ram, and configured to amplify the output value of the load cell; a setting unit installed inside the ram, and configured to set gain and offset values for the instrumentation amplifier; and a communication unit installed inside the ram, and configured to receive a control signal indicative of the gain and offset values from the control unit; the control unit may transmit the control signal including the gain and offset values to the communication unit in order to calibrate the load value; and the setting unit may set the gain and offset values for the instrumentation amplifier in accordance with the control signal received via the communication unit.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE INVENTION (First Embodiment)

Figure 1:
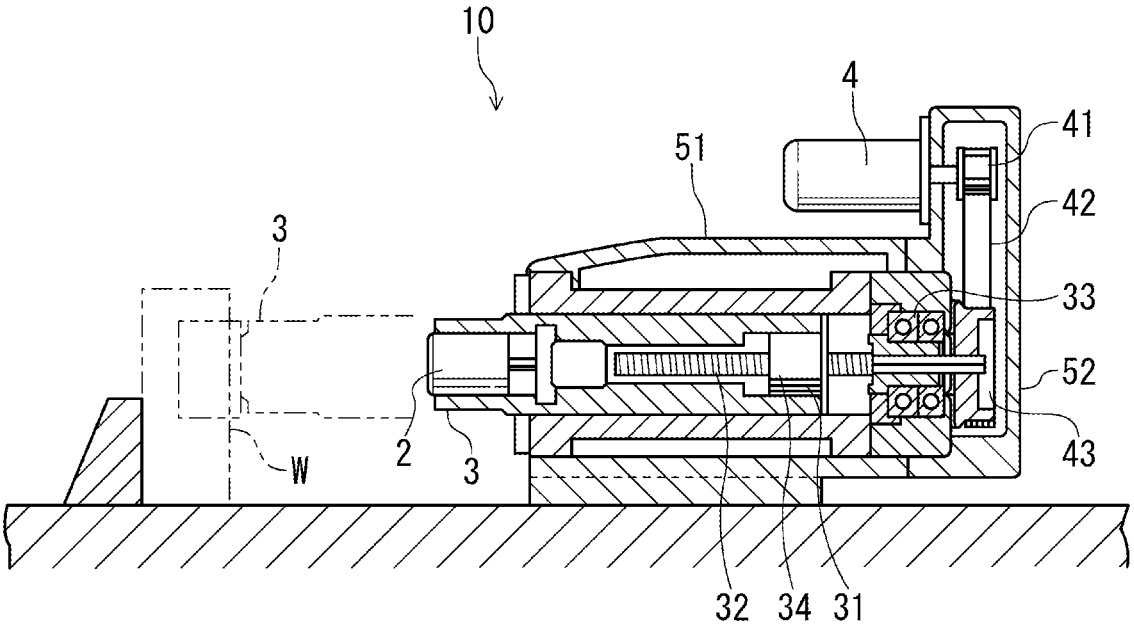
FIG. 1 is a diagram showing the overall configuration of an electric press according to a first embodiment.

An electric press 10 according to a first embodiment of the present invention will be described in detail below with reference to the accompanying drawings. The electric press 10 shown in FIG. 1 has, for example, a portable unit shape or a portable column shape. The electric press 10 includes a ram 3 and an electric motor 4, and functions to perform machining, such as indentation, compression or the like, on a workpiece W by driving the ram 3. A strain column 2 is detachably mounted on the front end of the ram 3. The electric press 10 applies a desired load to the workpiece W via the strain column 2 while detecting a load value, currently applied to the workpiece W, by using the strain column 2.

That is, the strain column 2 is a component used to compress the workpiece W, and also is a load detection element used to detect a load value applied to the workpiece W. The ram 3 is a guide configured to move the strain column 2 forward to and backward from the workpiece W, and also is an element configured to transmit compressing force. The ram 3 has a cylindrical shape, and is slidably inserted into and slidably supported in a press body 51. The electric motor 4 is an electric power source for an AC servo motor, etc., and is accommodated inside a casing 52 coupled to the press body 51.

A hollow portion that becomes wider along a cylindrical axis is formed inside the ram 3. A ball screw 31 is accommodated in the hollow portion. A screw shaft 32 shares a common axis with the ram 3, extends along the common axis, is rotatably supported by bearings 33, and is restrained from moving in an axial direction. A nut element 34 engages with the screw shaft 32 in a threaded manner, and fastens the outer circumferential surface of the nut element 34 onto the inner circumferential surface of the ram 3. The nut element 34 is moved along the screw shaft 32 by the rotation of the screw shaft 32, and the ram 3 is slid relative to the press body 51 while operating in conjunction with the nut element 34.

A transmission mechanism including a pulley 41, a belt 42, and a pulley 43 is interposed between the electric motor 4 and the screw shaft 32. The pulley 41 is fitted around the rotation shaft of the electric motor 4, the pulley 43 is fitted around the screw shaft 32, and the belt 42 is wound around the pulley 41 and the pulley 43 and couples the pulley 41 and the pulley 43 to each other. Rotating force is transmitted via the pulley 41, the belt 42 and the pulley 43 through the rotation of the pulley 41 in a circumferential direction by the electric motor 4, and the screw shaft 32 is rotated by the rotating force. The ball screw 31 converts the rotational movement of the electric motor 4 into rectilinear movement, and rectilinearly moves the ram 3.

Figure 2:
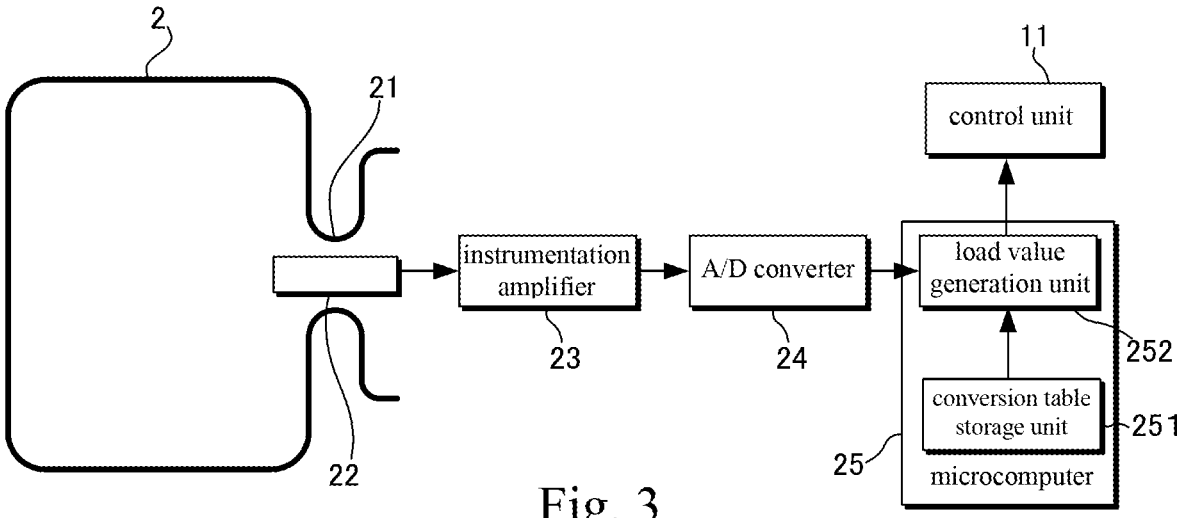
FIG. 2 is a sectional view showing the front end portion of a ram including a strain column.

As shown in FIG. 2, the strain column 2 has, for example, a column-type cylindrical shape, and includes a neck portion 21 in the axial direction thereof. When a load is applied onto the front end surface of the strain column 2, the neck portion 21 is compressed by stress concentration, and generates distortion adapted to increase the diameter thereof. The strain column 2 may be, for example, of a bending type or a shear type, and needs to apply a load to the workpiece W and to generate distortion in response to a load.

A load cell 22 is adhered to the neck portion 21 by a bonding agent or the like. The input terminal of the instrumentation amplifier 23 is connected to the load cell 22 via a signal line. The input terminal of an analog-to-digital (A/D) converter 24 is connected to the output terminal of the instrumentation amplifier 23, and the input terminal of the microcomputer 25 is connected to the output terminal of the A/D converter 24.

The load cell 22 includes, for example, a Wheatstone bridge as an example of a strain gauge. The load cell 22 changes electric resistance in proportion to the amount of distortion of the neck portion 21 attributable to a load applied to the strain column 2, and outputs an analog signal, such as a voltage value or the like, in proportion to the amount of distortion. There is a correlation between the amount of distortion and the load.

The instrumentation amplifier 23 is, for example, a differential amplifier, and amplifies the analog signal of the load cell 22. The instrumentation amplifier 23 multiplies the analog signal of the load cell 22 by a gain value, adds an offset value to the result of the multiplication, and then inputs an amplification result to the A/D converter 24. Furthermore, the instrumentation amplifier 23 includes an input terminal for a control signal as a separate mechanism, and sets gain and offset values included in an external control signal.

The A/D converter 24 converts the amplified signal into a digital signal, and outputs the digital signal to a control unit 11. The range of an analog signal that can be converted into a digital signal by the A/D converter 24 is fixed for a reason, such as the reason that the number of digits of a digital signal generated by the A/D converter 24 is fixed, and thus portions above or below the convertible range are clipped away. Accordingly, for a portion above the upper limit of the convertible range, saturation occurs, and all the same values are output. Furthermore, for a portion below the lower limit of the convertible range, saturation also occurs, and all the same values are output.

The microcomputer 25 includes a load value generation unit 252, and a conversion table storage unit 251 is connected to the load value generation unit 252. The conversion table storage unit 251 stores a conversion table between digital amplified values and load values in advance. The load value generation unit 252 searches for a load value paired with the output of the A/D converter 24, and outputs the corresponding load value to the control unit 11. That is, the load value generation unit 252 searches for a load value, paired with an amplified value identical to a search key, among load values arranged in the conversion table stored by the conversion table storage unit 251 by using the amplified value, output by the A/D converter 24 and converted into a digital signal, as the search key, generates data on the corresponding load value, and then outputs the data to the control unit 11 via a transmitted signal. The data on the corresponding load value is simply referred to as the "load value."

That is, a combination of the strain column 2, the load cell 22, the instrumentation amplifier 23, the A/D converter 24, and the microcomputer 25 is an example of a detection unit configured to detect a load value. The electric press 10 acquires a load value for the workpiece W by converting the output value of the load cell 22, configured to detect the distortion of the strain column 2, into a load value via the instrumentation amplifier 23, the A/D converter 24 and the microcomputer 25.

Figure 3:
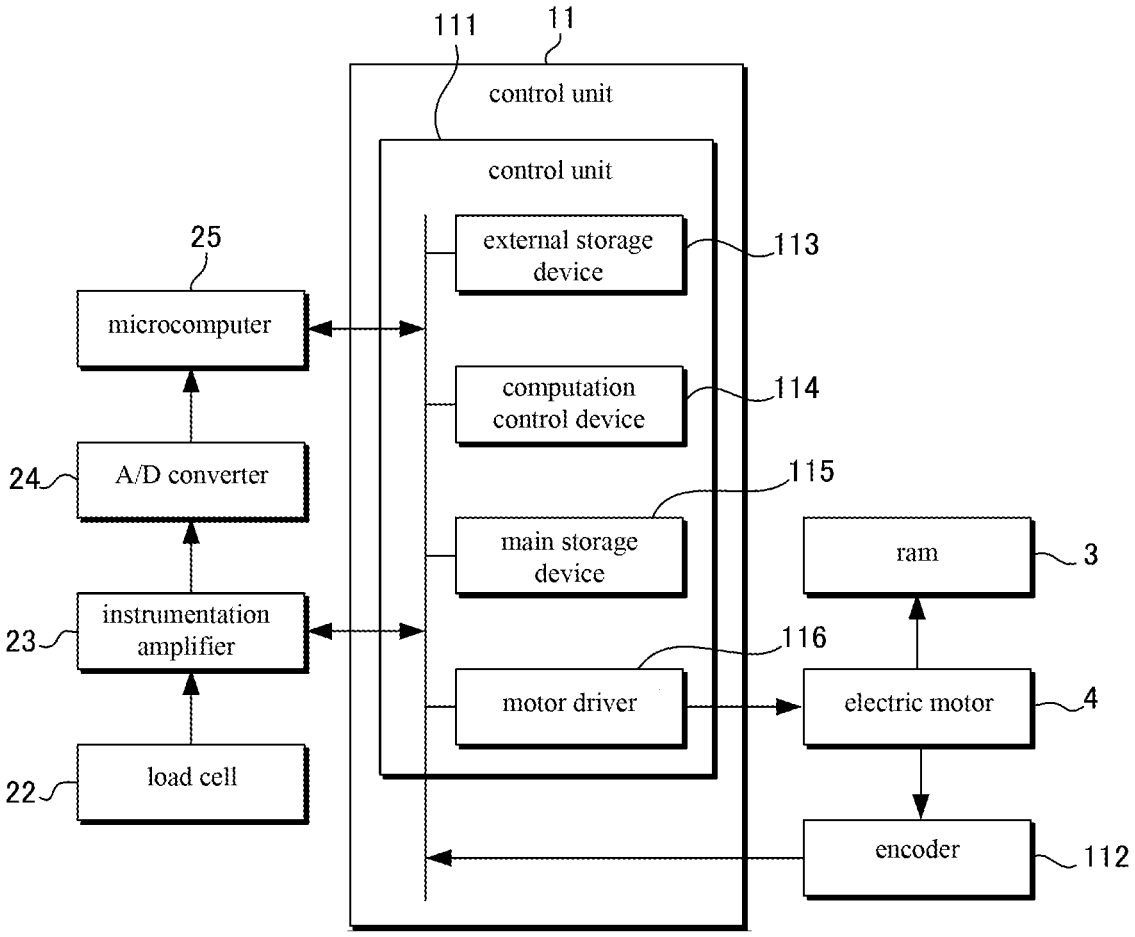
FIG. 3 is a block diagram showing the hardware configuration of a control unit.

As shown in FIG. 3, the electric press 10 includes the control unit 11 connected via a signal line. The control unit 11 includes a control unit 111 and an encoder 112. The control unit 111 includes an external storage device 113, such as a hard disk drive (HDD) or a solid disk drive (SSD), configured to store a program and data used to control the electric press 10. Furthermore, the control unit 111 includes a computation control device 114, such as a central processing unit (CPU) or the like, configured to execute a corresponding program, a main storage device 115, such as a RAM or the like, configured to temporarily store the computation result of the computation control device 114, and a motor driver 116 configured to drive the electric motor 4 under the control of the computation control device 114.

The computation control device 114 determines whether the load value output from the detection unit is equal to or greater than a desired load value by comparing the desired load value stored in the external storage device 113 with the load value output by the detection unit according to a program designed to machine the workpiece W. Correlations between load values and actual loads used by the control unit 11 are the same as correlations between output values of the reference load cell and actual loads. That is, an output value of the reference load cell and a load value used by the control unit, which represent the same load, are the same value, and thus the control unit 11 may directly compare the output value of the reference load cell with a desired load value without change.

The motor driver 116 transmits pulse signals to the electric motor 4 until the load value becomes a value that is equal to or greater than the desired load value. The encoder 112 notifies the control unit 111 of the contact of the strain column 2 with the workpiece W by outputting the amount of movement and speed of the electric motor 4 to the control unit 111.

Figure 4:
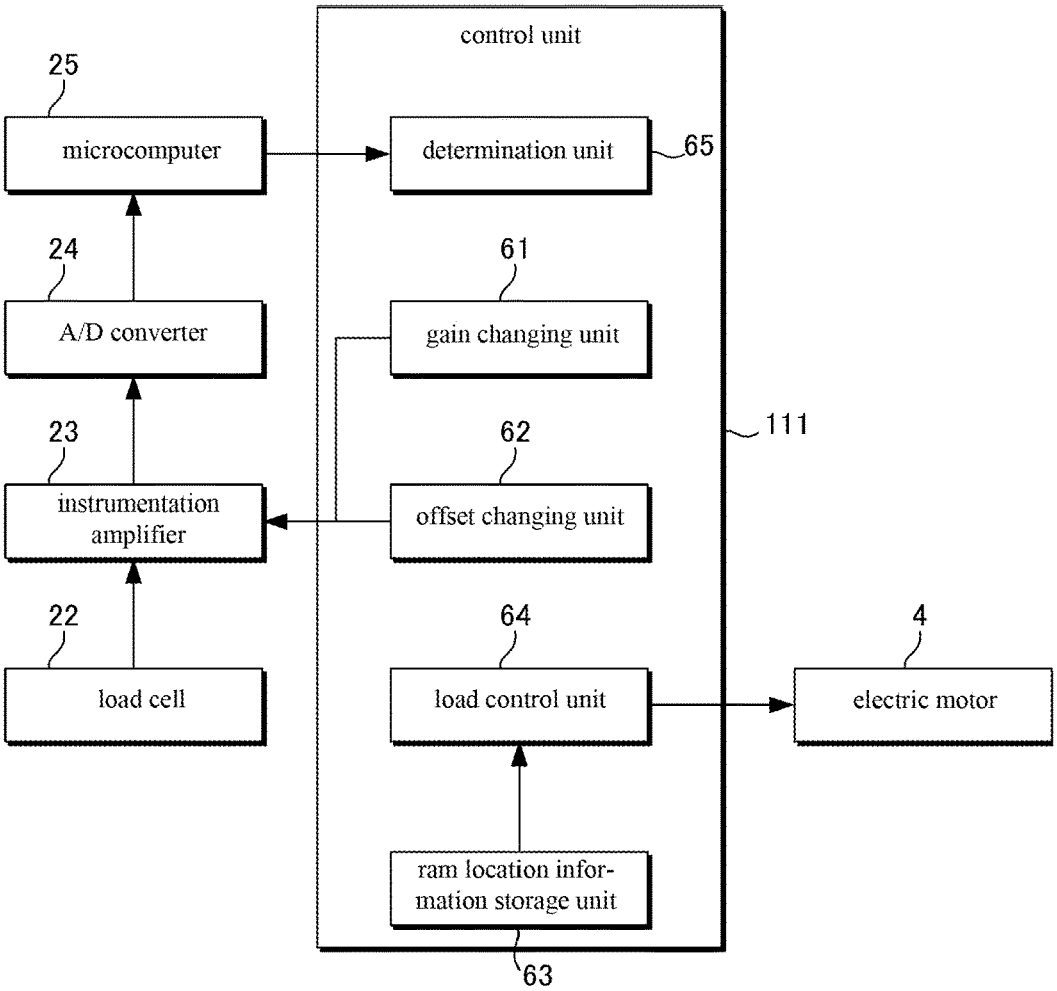
FIG. 4 is a block diagram showing the functional configuration of the control unit.

The control unit 11 also functions as a calibration device configured to calibrate the gain and offset values of the instrumentation amplifier 23. The external storage device 113 stores the calibration program and the data. As shown in FIG. 4, the control unit 111 includes a gain changing unit 61, an offset changing unit 62, a ram location information storage unit 63, a load control unit 64, and a determination unit 65 by the execution of the calibration program. The gain changing unit 61, the offset changing unit 62, the load control unit 64, and the determination unit 65 are configured to chiefly include the computation control device 114, and the ram location information storage unit 63 is configured to chiefly include the external storage device 113.

The gain changing unit 61 calculates a gain value, and sets the calculated gain value for the instrumentation amplifier 23. An algorithm for the calculation of the gain value may be, for example, a ratio-based increase and decrease method. The gain changing unit 61 changes the multiplication factor of the gain value to meet the measured change ratio of the load cell 22, and then performs fine adjustment by increasing or decreasing the gain value while decreasing a change ratio on a per one half basis in order to acquire an appropriate gain value.

The offset changing unit 62 calculates an offset value, and sets the calculated offset value for the instrumentation amplifier 23. The algorithm of the offset changing unit 62 is, for example, a pitch method. The gain changing unit 61 provisionally sets a gain value, and the offset changing unit 62 finely and appropriately adjusts an offset value based on the provisional gain value by increasing or decreasing the offset value on a per pitch basis.

The ram location information storage unit 63 stores a plurality of pieces of ram location information. Each piece of ram location information represents a correlation between an actual load for the workpiece W and the location of the ram 3. In other words, the ram location information corresponds to the location to which the ram 3 is moved because the workpiece W and the strain column 2 are distorted by a desired load after the strain column 2 has been brought into contact with the workpiece W. The respective pieces of ram location information represent the location of the ram 3 when the electric press 10 applies a load corresponding to 10% of a rated load to the workpiece W, the location of the ram 3 when the electric press 10 applies a load corresponding to 30% of the rated load to the workpiece W, and the location of the ram 3 when the electric press 10 applies a load corresponding to 60% of the rated load to the workpiece W.

The load control unit 64 reads ram location information, moves the ram 3 to a location consistent with the ram location information, and applies a load, corresponding to the location represented by the ram location information, to the workpiece W. Typically, the load control unit 64 moves the ram 3 through sequence control by outputting the number of pulses consistent with the ram location information to the electric motor 4. Alternatively, the load control unit 64 receives the ram location information, and transmits the ram location information to the electric motor 4 to be driven.

Figure 5:
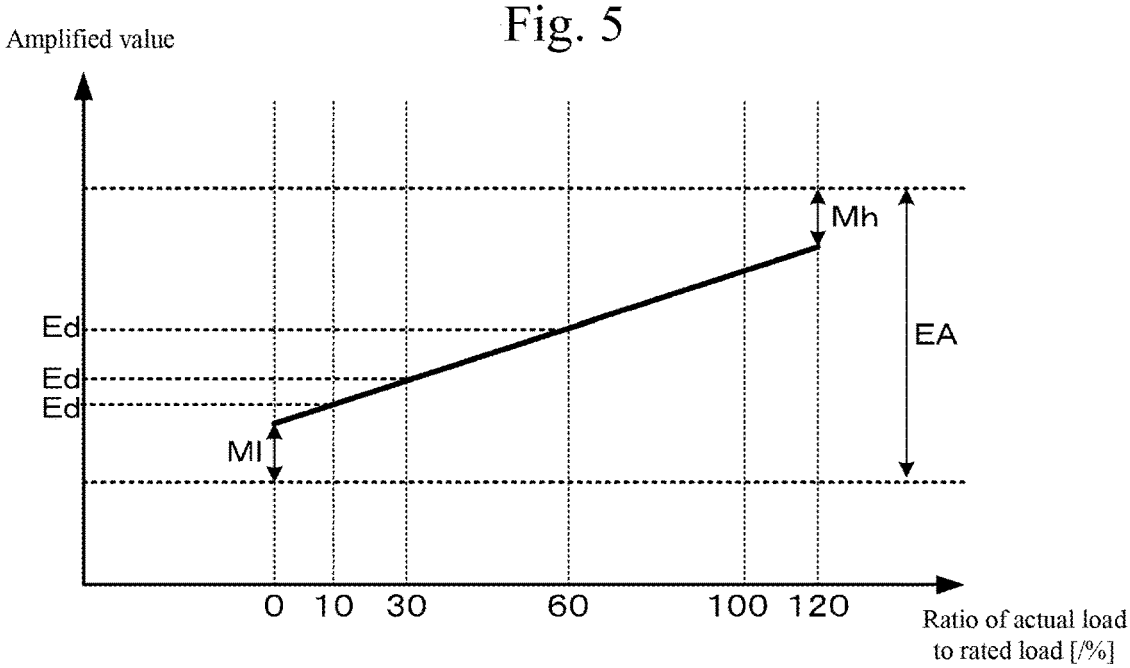
FIG. 5 is a graph plotting correlations between appropriate actual loads and amplified values.

The determination unit 65 determines whether the gain and offset values acquired by the gain changing unit 61 and the offset changing unit 62 are appropriate based on the output value of the instrumentation amplifier 23 when the load is applied to the workpiece W. FIG. 5 is a graph plotting appropriate correlations between loads and amplified values, in which a lateral axis represents the ratio of a load to the rated load and a vertical axis represents the output value of the instrumentation amplifier 23.

As shown in FIG. 5, the control unit 11 is a device configured to adjust the instrumentation amplifier 23. The control unit 11 adjusts the gain and offset values so that all the output values ranging from the output value of the instrumentation amplifier 23 when no load is applied to the workpiece W, i.e., an applied load corresponds to 0% of the rated load, to the output value of the instrumentation amplifier 23 when a load corresponding to 120% of the rated load is applied to workpiece W fall within the convertible range EA of the A/D converter 24.

Furthermore, the control unit 11 sets a lower limit margin MI between the output value of the instrumentation amplifier 23, when no load is applied to the workpiece W, and the lower limit value of the convertible range EA, and sets an upper limit margin Mh between the output value of the instrumentation amplifier 23, when a load corresponding to 120% of the rated load is applied to the workpiece W, and the upper limit value of the convertible range EA.

Since the lower limit margin MI and the upper limit margin Mh may have the same value or different values, they may be determined based on the predicted change characteristic of the load cell 22. For example, when the output value of the load cell 22 tends to drift in a rising direction due to a change over time, it is desirable to set the upper limit margin to a greater value and set the lower limit margin to a small value including, for example, 0.

Typically, the determination unit 65 may determine whether the output value of the instrumentation amplifier 23 when a load corresponding to 30% of the rated load is applied and the output value of the instrumentation amplifier 23 when a load corresponding to 60% of the rated load is applied fall within respective prescribed ranges Ed on the assumption that the output of the load cell 22 is proportional to the applied load, and may determine that the gain value and the offset value are appropriate when the two output values fall within the respective prescribed ranges.

The prescribed range Ed is a range between points where output values for 30% and 60% of the rated load are located when, in a rectilinear amplification characteristic estimated from the two output values, an estimated output value when the rated load is 0% is equal to or higher than the lower limit margin Ml and is close to the lower limit margin Ml and an estimated output value when the rated load is 120% is equal to or lower than the upper limit margin Mh and is close to the upper limit margin Mh. With regard to this vicinity, in order to maximally increase the resolution of the instrumentation amplifier 23, 0 is preferable as long as it is possible. In contrast, when the prescribed range Ed is strict, calibration may take a long period of time. Accordingly, it is preferable to determine the prescribed range Ed by considering a trade-off between the resolution and the calibration time.

The gain changing unit 61 and the offset changing unit 62 repeatedly change the gain and offset values until the determination unit 65 determines that all the two values fall within the prescribed ranges Ed. The load control unit 64 collects the output value of the instrumentation amplifier 23 whenever the gain value and the offset value are changed. The determination unit 65 repeats the determination whenever the output value of the instrumentation amplifier 23 is collected.

In an actual example, the output value and load of the instrumentation amplifier 23 are rectilinearly proportional to each other. Any one of the output value of the instrumentation amplifier 23, the output value of the A/D converter 24 and the output value of the microcomputer 25 may be used as the determination element of the determination unit 65.

Figure 6:
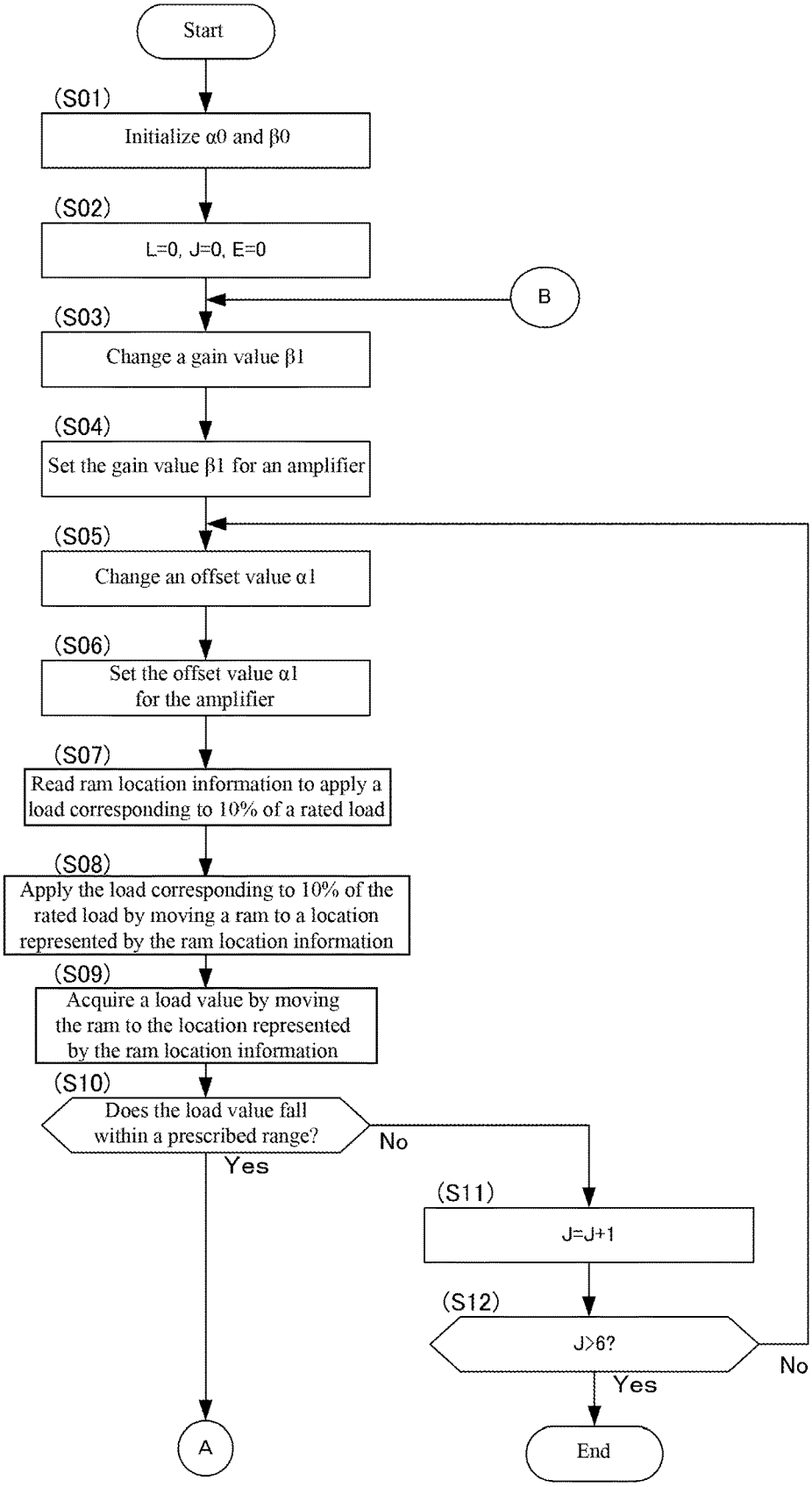
FIG. 6 is a schematic flowchart showing the first half part of the calibration operation of an instrumentation amplifier according to the first embodiment.
Figure 7:
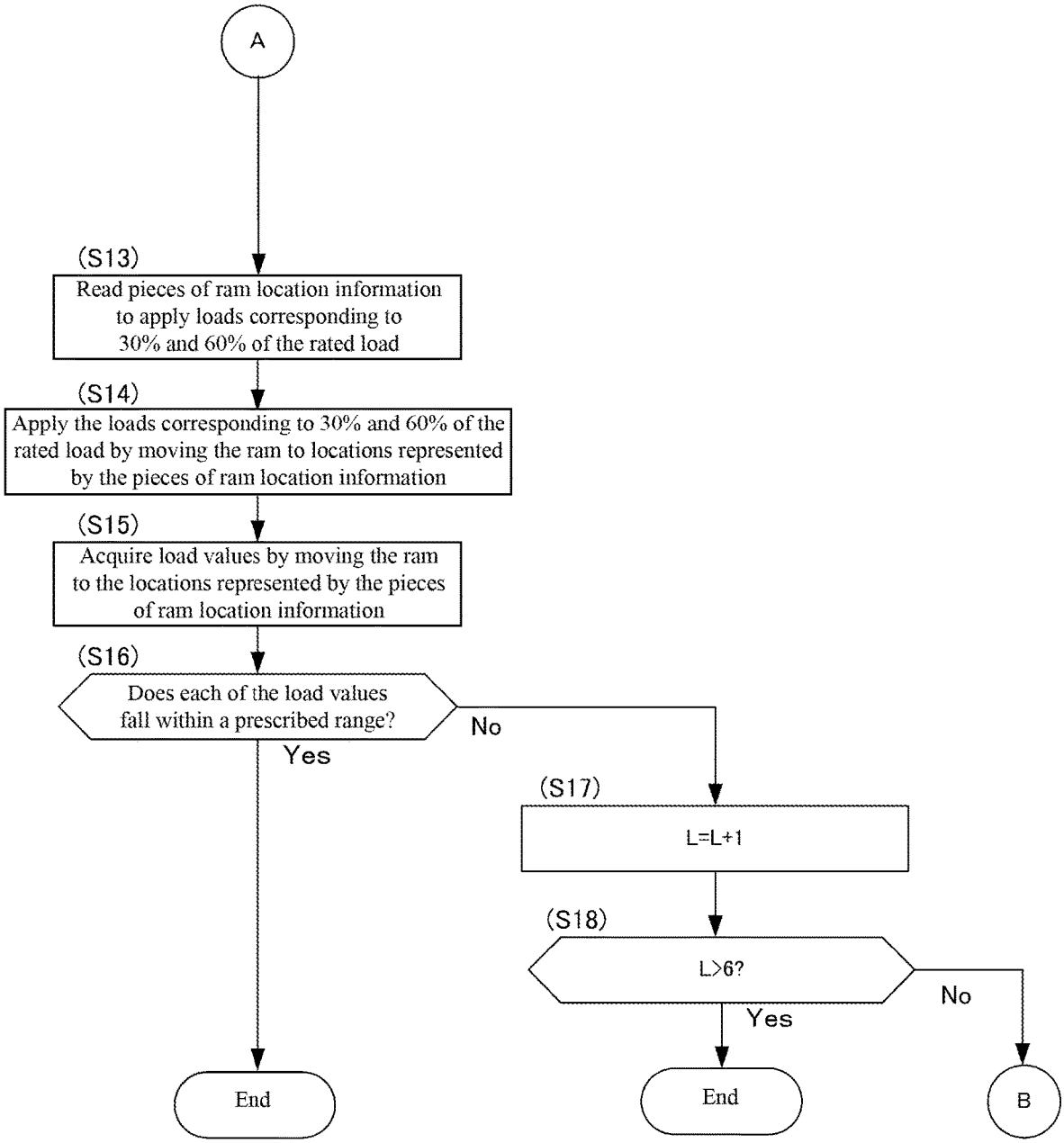
FIG. 7 is a schematic flowchart showing the second half part of the calibration operation of the instrumentation amplifier according to the first embodiment.

FIGS. 6 and 7 are flowcharts showing the calibration operation of the instrumentation amplifier 23 by the control unit 11. First, the gain changing unit 61 and the offset changing unit 62 set an initial value $\beta 0$ and an initial value $\alpha 0$, respectively, at step S01. Furthermore, the determination unit 65 initializes the number L of repetitions of calibration to 0, and initializes the number J of repetitions of the calibration of an offset value and an adjustment coefficient E, to be described later, to 0 at step S02.

The initial value $\beta 0$ is an ideal gain value that is set for the case of no change in the load cell 22. The initial value $\alpha 0$ is an ideal offset value that is set for the case of no change in the load cell 22. It is desirable to measure the initial value $\beta 0$ and the initial value $\alpha 0$ upon the installation of the electric press 10 and to store the initial value $\beta 0$ and the initial value $\alpha 0$ in the external storage device 113.

After various types of initialization have been completed, the gain changing unit 61 changes the gain value $\beta 1$ at step S03 and sets the changed gain value $\beta 1$ for the instrumentation amplifier 23 at step S04, and the offset changing unit 62 changes the offset value $\alpha 1$ at step S05 and sets the changed offset value $\alpha 1$ for the instrumentation amplifier 23 at step S06, as will be described later.

After the gain value $\beta 1$ and the offset value $\alpha 1$ have been set, the load control unit 64 reads ram location information corresponding to 10% of a rated load from the ram location information storage unit 63 at step S07. The load control unit 64 applies a load corresponding to 10% of the rated load to the workpiece W by moving the ram 3 to a location represented by the read ram location information at step S08. In this case, the load control unit 64 moves the ram 3 to a location consistent with the ram location information through sequence control by outputting the number of pulses, consistent with the amount of movement to the location represented by the ram location information, to the electric motor 4. Alternatively, the load control unit 64 transmits the ram location information to the electric motor 4.

An analog signal corresponding to the load corresponding to 10% of the rated load is output from the load cell 22. The instrumentation amplifier 23 multiplies the value of the analog signal, input from the load cell 22, by the gain value $\beta 1$ changed by the gain changing unit 61, adds the offset value $\alpha 1$ changed by the offset changing unit 62 to the result of the multiplication, and then outputs the result of the addition as a load value. The A/D converter 24 converts the load value, input from the instrumentation amplifier 23, into a digital signal, and then inputs the digital value to the control unit 11.

The determination unit 65 receives the load value, represented by the digital signal, from the A/D converter 24 when the load corresponding to 10% of the rated load is applied at step S09, and determines whether the load value falls within a prescribed range at step S10. When the load value does not fall within the prescribed range in the case of No at step S10, the determination unit 65 increases the number J of repetitions of calibration of an offset value by 1 at step S11, and determines whether the number J of repetitions reaches a prescribed value at step S12. When the number J of repetitions reaches the prescribed value in the case of No at step S12, the offset changing unit 62 returns to step S05, changes the offset value, and then sets the changed offset value for the instrumentation amplifier 23.

Meanwhile, when the number J of repetitions of calibration of the offset value reaches the prescribed value in the case of Yes at step S12, the determination unit 65 generates an error log, and ends the calibration operation.

When the determination unit 65 determines that the load value falls within the prescribed range in the case of Yes at step S10, the load control unit 64 reads two pieces of ram location information, corresponding 30% and 60% of the rated load, respectively, from the ram location information storage unit 63 at step S13, and applies loads corresponding to 30% and 60% of the rated load, respectively, to the workpiece W by sequentially moving the ram 3 to locations represented by the respective pieces of ram location information at step S14.

In this case, analog signal loads corresponding to loads corresponding to 30% and 60% of the rated load are sequentially output from the load cell 22. The instrumentation amplifier 23 multiplies the values of the analog signals, input from the load cell 22 by the gain value changed by the gain changing unit 61, adds the offset value changed by the offset changing unit 62 to the results of the multiplication, and then outputs the results of the addition as load values. The A/D converter 24 converts the two load values, input from the instrumentation amplifier 23, into digital signals, and inputs the digital values to the control unit 11.

The determination unit 65 receives the two load values, represented by the digital signals, from A/D converter 24 when the loads corresponding to 30% of the rated load and 60% of the rated load are applied at step S15, and determines whether the load values fall within respective prescribed ranges at step S16. When the two load values do not fall within the respective prescribed ranges in the case of No at step S16, the determination unit 65 increases the number L of repetitions of calibration by 1 at step S17, and determines whether the number L of repetitions reaches a prescribed value at step S18.

When the number L of repetitions does not reach the prescribed value in the case of No at step S18, the process returns to step S03, the gain changing unit 61 and the offset changing unit 62 changes the gain value β1 and the offset value α1 again, and sets the changed gain value β1 and the offset value α1 for the instrumentation amplifier 23.

Meanwhile, when the number L of repetitions of calibration reaches the prescribed value in the case of Yes at step S18, the determination unit 65 generates an error log, and terminates the calibration operation. Furthermore, when the determination unit 65 determines that the load values fall within the respective prescribed ranges in the case of Yes at step S16, the determination unit 65 considers that the appropriate gain value β1 and offset value α1 have been set for the instrumentation amplifier 23, and ends the process.

The calibration operation is performed by provisionally setting a gain value, adjusting an offset value based on the provisionally set gain value, and determining whether the output value of the A/D converter 24 is saturated for the amplification of the instrumentation amplifier 23 based on the provisionally set gain value and the offset value.

In the adjustment of the offset value, the electric press 10 determines a correlation between the output value of the instrumentation amplifier 23 and a prescribed range when a load corresponding to 10% of the rated load is applied to the workpiece W. The reason for this is that, when a load corresponds to 0% of the rated load, the output value of the instrumentation amplifier 23 deviates from the convertible range of the A/D converter 24, and there is a concern that a saturated value has been input to the determination unit 65, thereby degrading the reliability of determination. 10% of the rated load is a value that is close to 0% of the rated load, and also an empirical or reasonable value at which the output value of the instrumentation amplifier 23 is not saturated by digital conversion. Accordingly, the load is not limited to only 10% of the rated load as long as the above condition is fulfilled.

Furthermore, the determination may be performed by using a value that is a value which is close to 120% of the rated load and that is an empirical or reasonable value at which a digital value is not saturated by a change in the characteristic of the load cell 22. However, compared to a machining operation instantaneously applying a load to the workpiece W, the calibration operation of the instrumentation amplifier 23 requires that a load is applied to the workpiece W over a long period of time in order to acquire data. During the application of the load, a high-load state in which a high load is applied to the electric press 10 continues. Accordingly, it is preferred that a load having a value close to 0% of the rated load is applied.

To determine whether the gain and offset values are appropriate, the electric press 10 applies loads corresponding to 30% and 60% of the rated load to the workpiece W, and determines whether output values fall within the respective prescribed ranges of the instrumentation amplifier 23. The loads are not limited to only 30% and 60% of the rated load as long as the correlations between two output values and respective prescribed ranges can be determined. However, it is preferred that: first, the output values of the instrumentation amplifier 23 are values that are values which are close to 50% of the rated load and empirical and reasonable values; second, the two output values are separated from each other as much as possible; and, third, the electric press 10 is not exposed to a high-load state over a long period of time.

Furthermore, in this calibration operation, even when a load corresponding to 120% of the rated load is applied to the workpiece W, the gain value and the offset value are set such that the output value of the instrumentation amplifier 23 is not saturated by digital conversion. The reason for this is to take measures to prevent a failure of the electric press 10, as in the case of, when the electric press 10 is in an excessive load state during the machining of the workpiece W, detecting an excessive load and automatically stopping the electric press 10.

Furthermore, in this calibration operation, when loads corresponding to 10%, 30% and 60% of the rated load are applied, the load control unit 64 moves the ram 3 by using locations as target values, rather than using loads as target values. The present embodiment is not limited thereto, and it may be possible to install a reference load cell in place of the workpiece W, to monitor the output values of the reference load cell, and to move the ram 3 until the output values reach 10%, 30% and 60% of the rated load. The reference load cell includes its own load cell, an instrumentation amplifier, an A/D converter, and a microcomputer, and provides output values appropriate for actual loads.

However, when the ram 3 is driven through load monitoring, the electric motor 4 is stopped in response to the output of a desired load value from the reference load cell. In this case, there is a concern that the ram 3 overshoots an appropriate location due to the influence of an accumulated pulse or the like. That is, there is a concern that the ram 3 passes a location at which a desired load is applied. To prevent such an overshoot, it is preferable to install a die set spring under a standard load cell. However, when it is impossible to install a die set spring, it is preferable to suppress an overshoot by reducing the speed of the ram 3.

Meanwhile, when the location of the ram 3 for a desired load is stored and the ram 3 is moved to the stored location, an overshoot may be reduced to 0 or an extremely small value even in the case of the high-speed movement of the ram 3. Although it is necessary to move the ram 3 at a speed of 0.1 mm/sec when there is no die set spring, an overshoot may be suppressed even in the case where the ram 3 is moved at a speed of 5 mm/sec when the ram is moved based on ram location information.

As a result, in the electric press 10 of the present embodiment, calibration operation time is significantly reduced. Furthermore, since the moving time of the ram 3 does not exceed the allowable holding time of the electric motor 4 and a reattempt at calibration attributable to the occurrence of an error does not occur, calibration operation time can be predicted.

Figure 8:
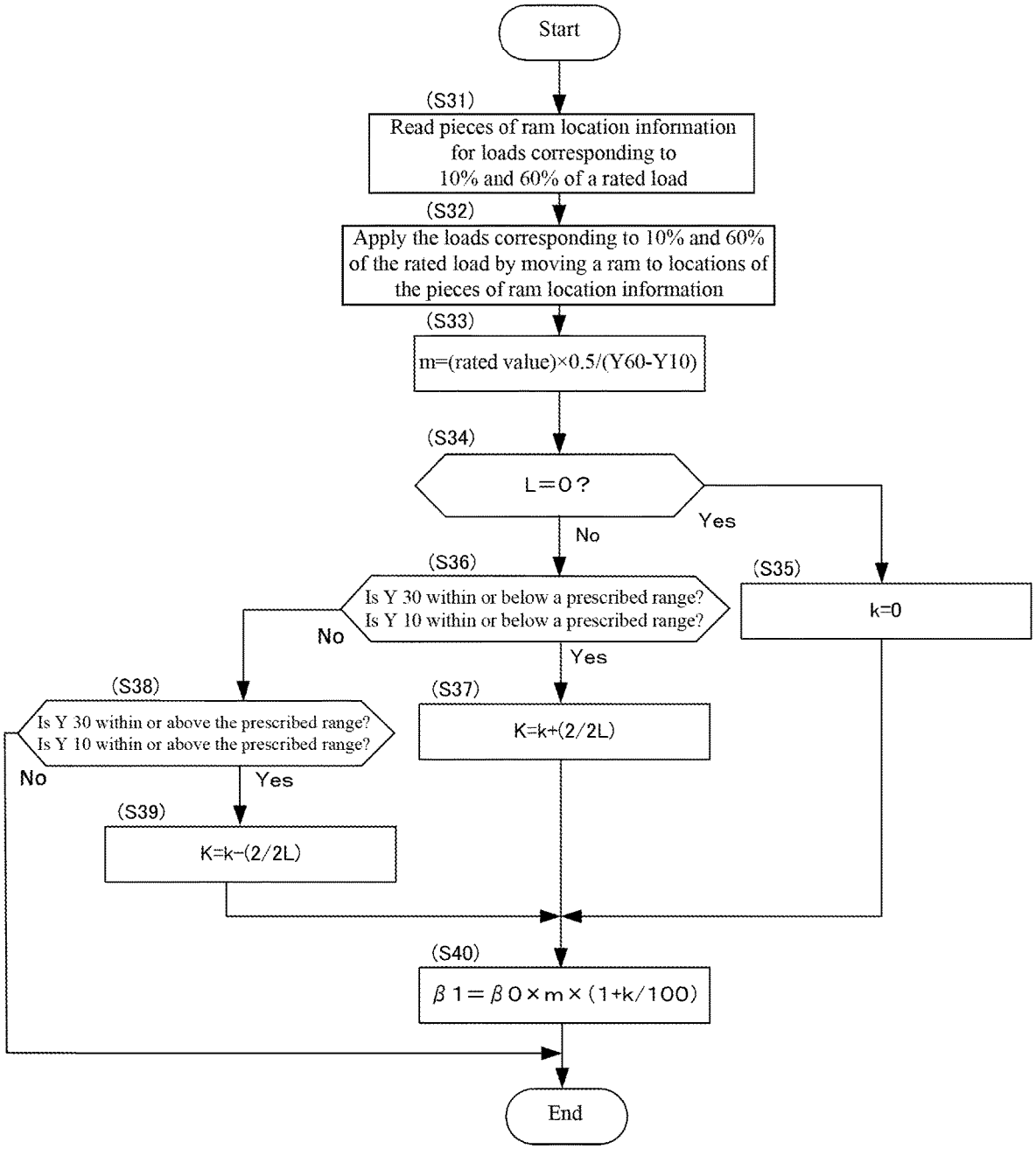
FIG. 8 is a schematic flowchart showing an operation of changing a gain value in the calibration operation of the instrumentation amplifier according to the first embodiment.

FIG. 8 is a flowchart showing the operation of changing a gain value at step S03. First, the load control unit 64 reads two pieces of ram location information corresponding 10% and 60% of the rated load from the ram location information storage unit 63 at step S31, and applies loads corresponding to 10% and 60% of the rated load to the workpiece W by sequentially moving the ram 3 into locations represented by the respective pieces of ram location information at step S32.

Thereafter, the gain changing unit 61 sets an adjustment coefficient m at step S33. The adjustment coefficient m is a result that is obtained by dividing the half of the rated load by the difference between the load value Y 60 when a load corresponding to 60% of the rated load is applied and a load value Y 10 when the load corresponding to 10% of the rated load is applied. A separation value between two load values that are obtained when the loads corresponding to 10% and 60% of the rated load are applied corresponds to the half of the value of the rated load.

Furthermore, the gain changing unit 61 sets a fine adjustment coefficient k at steps S34 to S39. When the number L of repetitions of calibration is 0 in the case of Yes at step S34, the fine adjustment coefficient k is set to 0 at step S35. Meanwhile, when the number L of repetitions is not 0 in the case of No at step S34, the fine adjustment coefficient k is changed in the manner in which the two load values for 30% and 60% of the rated load deviate from the prescribed ranges, as in the determination of step S16 at steps S36 to S39.

When the load value Y 30 for the load corresponding to 30% of the rated load falls within or below a prescribed range and the load value Y 60 for the load corresponding to 60% of the rated load falls within or below a prescribed range in the case of Yes at step S36, the gain changing unit 61 adds a value, obtained by multiplying the number L of repetitions by 2 and then dividing 2 by the result of the multiplication, to the fine adjustment coefficient k of the previous round at step S37.

Meanwhile, when the load value Y 30 for the load corresponding to 30% of the rated load falls within or above the prescribed range and the load value 60 for the load corresponding to 60% of the rated load falls within or above the prescribed range in the case of Yes at step S38, the gain changing unit 61 subtracts a value, obtained by multiplying the number L of repetitions by 2 and then dividing 2 by the result of the multiplication, from the fine adjustment coefficient k of the previous round at step S39. Furthermore, in the case of No at both steps S36 and S38, the calibration operation of the instrumentation amplifier 23 is ended as an error.

Furthermore, the gain changing unit 61 generates a gain value β1 by using the initial value β0, the adjustment coefficient m and the fine adjustment coefficient k as parameters at step S40. That is, the gain changing unit 61 multiplies the initial value β0 by the coefficient m. Furthermore, the gain changing unit 61 calculates a value by dividing the fine adjustment coefficient k by 100 and adding 1 to the result of the division. Furthermore, the gain changing unit 61 multiplies the two calculation results.

According to the method for changing the gain value β1, the gain value is modified from the initial value β0 in an ideal state to a value, into which a change in the characteristic of the load cell 22 has been schematically incorporated, by multiplying the coefficient m by the initial value β0. That is, the coefficient m is an adjustment ratio that enables the gain value β1 to schematically correspond to the change in the characteristic of the load cell 22.

Furthermore, according to the method for calculating the fine adjustment coefficient k, although the fine adjustment coefficient k is 0 in the first setting of the gain value β1, the gain value β1 is increased or decreased by 1% of the value of the previous round in the second fine adjustment, the gain value β1 is increased or decreased by 0.5% of the value of the previous round in the third fine adjustment, and the gain value β1 is increased or decreased by 0.25% of the value of the previous round in the fourth fine adjustment, thereby gradually approaching an appropriate value with accuracy. The fine adjustment coefficient k is a fine adjustment ratio adapted to accurately change the gain value β1.

Figure 9:
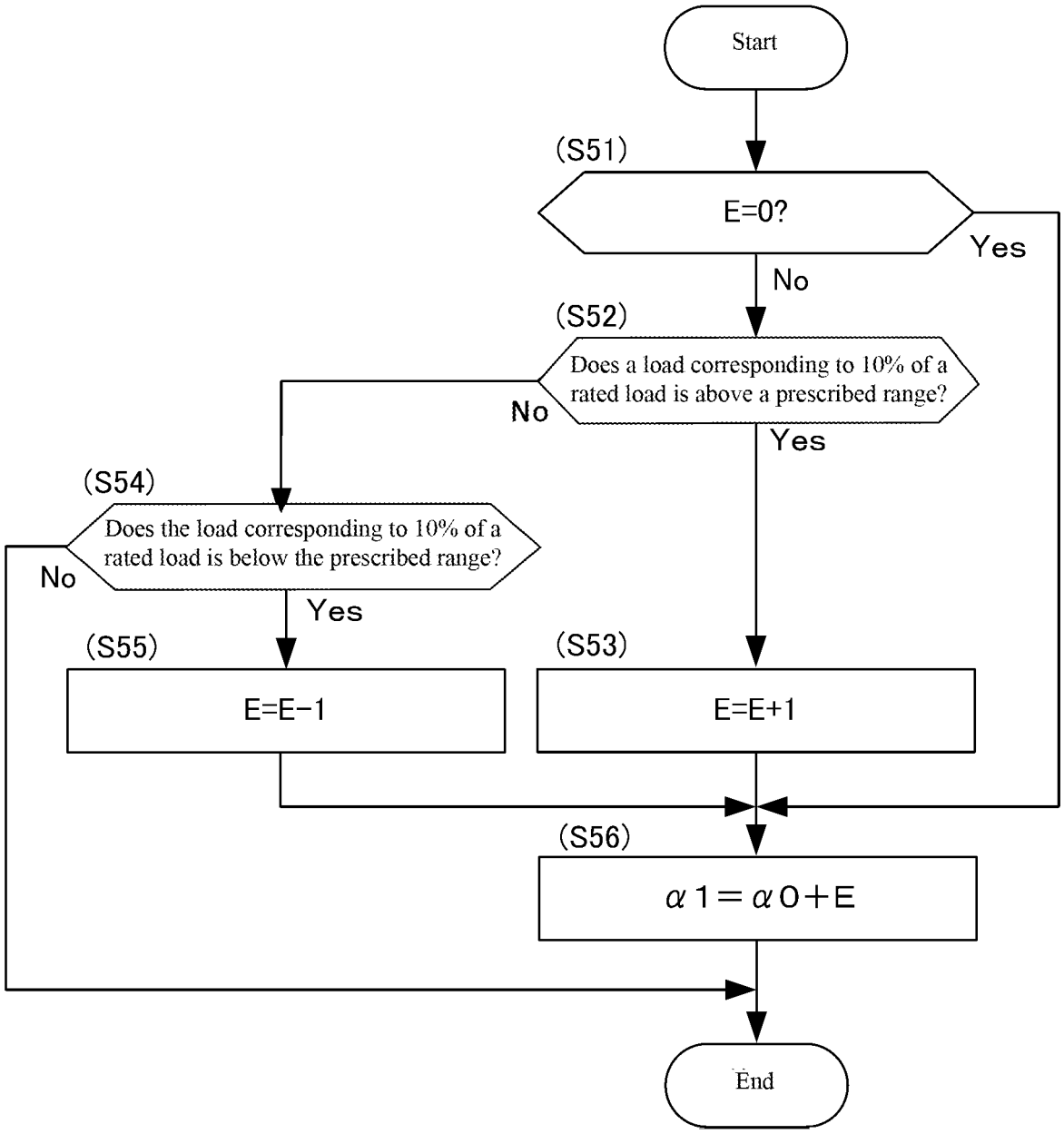
FIG. 9 is a schematic flowchart showing an operation of changing an offset value in the calibration operation of the instrumentation amplifier according to the first embodiment.

FIG. 9 is a flowchart showing the operation of changing the offset value α1 at step S05. First, the offset changing unit 62 sets the adjustment coefficient E at steps S51 to S55. When the number E of repetitions of calibration is not 0 in the case of No at step S51, the adjustment coefficient E is changed in the manner in which the load value for 10% of the rated load deviates from the prescribed range, as in the determination of step S10 at steps S52 to S53.

When the load value for 10% of the rated load exceeds the prescribed range in the case of Yes at step S52, the offset changing unit 62 increases the adjustment coefficient E by 1 at step S53. Meanwhile, when the load value for 10% of the rated load is below the prescribed range in the case of Yes at step S54, the offset changing unit 62 decreases the adjustment coefficient E by 1 at step S55.

Furthermore, the offset changing unit 62 generates an offset value α1 by using the initial value α0 and the adjustment coefficient E as parameters at step S56. That is, the offset changing unit 62 adds the adjustment coefficient E to the initial value α0.

The reason for increasing or decreasing the gain value β1 at the ratio and increasing or decreasing the offset value α1 on a per pitch basis is that the settable range of the gain value β1 is relatively wide and the settable range of the offset value α1 is relatively narrow. Accordingly, depending on the widths of the settable ranges of the gain value β1 and the offset value α1, the pitch method may be used for the setting of both the gain value β1 and the offset value α1, the ratio-based increase and decrease method may be used for the setting of both the gain value β1 and the offset value α1, or the pitch method may be used for the setting of the gain value β1 and the ratio-based increase and decrease method may be used for the setting of the offset value α1.

As described above, the electric press 10 includes the detection unit configured to detect the load value of a compression target called the workpiece W or the reference load cell. The detection unit includes the strain column 2, the load cell 22, the instrumentation amplifier 23, the A/D converter 24, and the microcomputer 25 as the components thereof. To calibrate the load value of the detection unit, the electric press 10 stores ram location information, representing correlations between actual loads applied to the compression target and the locations of the ram 3, in advance. Furthermore, the load value is calibrated by applying an actual load, represented by the ram location information, to the compression target by moving the ram 3 to a location represented by the ram location information. In the present embodiment, the gain and offset values of the instrumentation amplifier 23, which are used to generate a load value, are changed.

That is, during the calibration operation, control configured to move the ram 3 to a known location is performed in place of control configured to detect a prescribed load and stop the ram 3. Accordingly, even when the ram 3 is moved at high speed, the overshoot of the ram 3 is suppressed. Accordingly, the time required for the calibration operation can be reduced by the high speed movement of the ram 3, and thus facility stopping time is shortened, thereby improving the manufacturing efficiency of workpiece.

Furthermore, the frequency of the calibration operation can be increased, and thus the upper limit margin and the lower limit margin do not need to be set to large values in preparation for a change in the load cell 22 over time, thereby improving the resolution of the instrumentation amplifier 23. Accordingly, the machining accuracy of the electric press 10 is also improved.

(Second Embodiment

An electric press according to a second embodiment of the present invention will be described in detail below with reference to the accompanying drawings. The same reference symbols will be assigned to components and functions that are the same as those of the first embodiment, and detailed descriptions thereof will be omitted.

Figure 10:
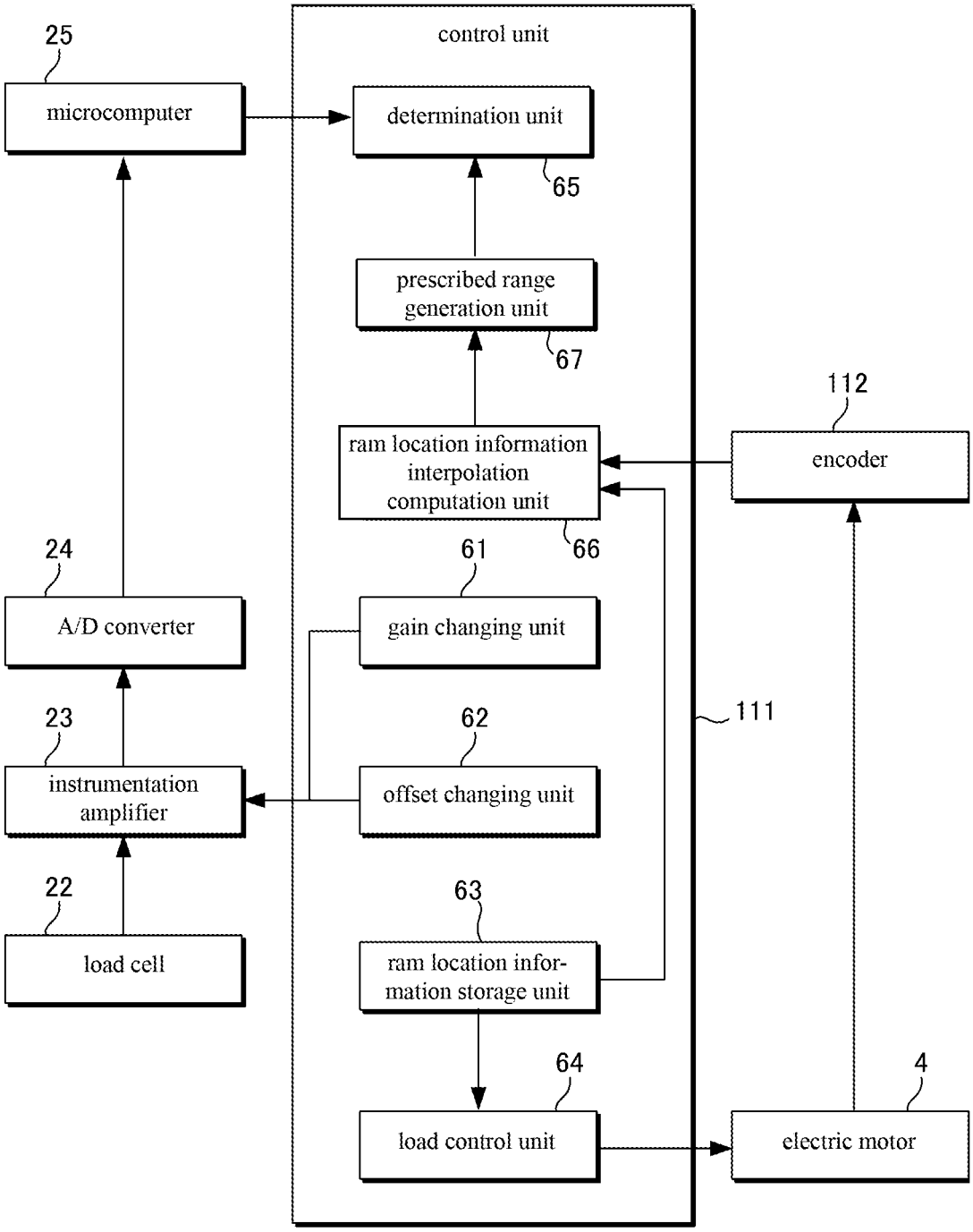
FIG. 10 is a block diagram showing the functional configuration of the control unit of an electric press according to a second embodiment.

As shown in FIG. 10, the control unit 111 of the electric press 10 includes a ram location information interpolation computation unit 66, and a prescribed range generation unit 67. The ram location information interpolation computation unit 66 and the prescribed range generation unit 67 are each configured to include a computation control device 114.

The ram location information interpolation computation unit 66 interpolates ram location information absent in the ram location information storage unit 63 by using an interpolation method, and calculates an actual load for the location of the ram 3. The prescribed range generation unit 67 generates a prescribed range for the load calculated by the ram location information interpolation computation unit 66. In the calibration operation of the instrumentation amplifier 23, the determination unit 65 determines whether the load value output by the load cell 22 falls within the prescribed range generated by the prescribed range generation unit 67.

In the case of controlling the location of the ram 3 based on the encoder 112, even when the location of the ram 3 is monitored in place of the load, there is a considerable concern about an overshoot. Furthermore, there is a considerably concern about an overshoot attributable to a change in mechanical error over time. When an actual load for a workpiece W becomes different from a desired load due to an overshoot, the determination accuracy of the determination unit 65 is degraded in the setting of the gain value and the offset value.

Even when an actual load for the workpiece W is different from a desired load, the electric press 10 can calculate the actual load for the workpiece W through interpolation using known ram location information and can perform determination based on the actual load for the workpiece W, and thus the electric press 10 can set the gain and offset values with high accuracy.

(Third Embodiment)

An electric press according to a third embodiment of the present invention will be described in detail below with reference to the accompanying drawings. The same reference symbols will be assigned to components and functions that are the same as those of the first embodiment, and detailed descriptions thereof will be omitted.

Figure 11:
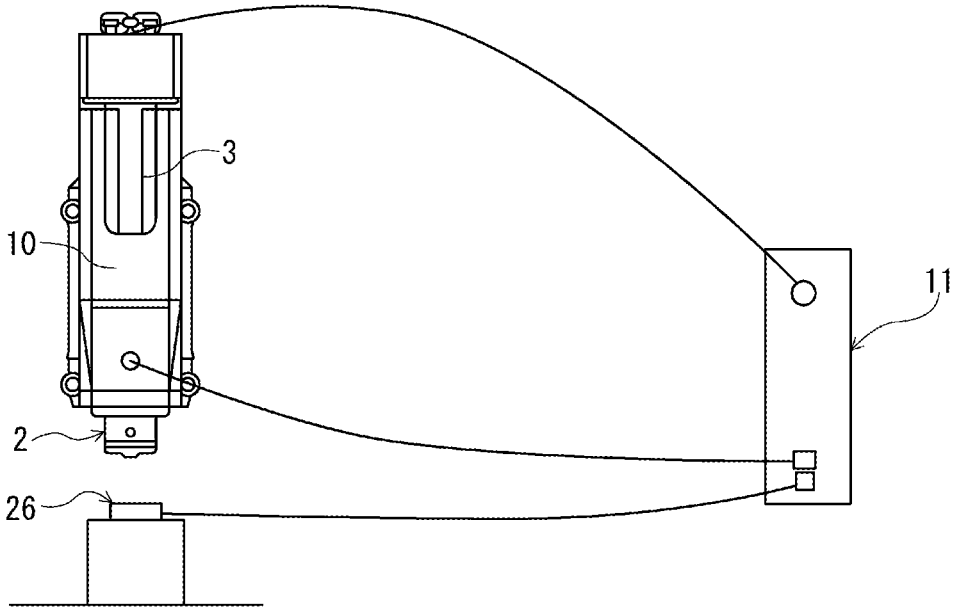
FIG. 11 is a diagram showing the state of an electric press during the calibration operation of an instrumentation amplifier according to a third embodiment.

As shown in FIG. 11, in the present embodiment, a reference load cell 26 is installed in place of a workpiece W in the calibration of the instrumentation amplifier 23. The reference load cell 26 is a unit including a load cell, an instrumentation amplifier and an A/D converter in itself, and outputs an appropriate load detection value because the reference load cell 26 already knows correlations between loads and output values. The reference load cell 26 is connected to a control unit 11 via a signal line, and inputs the load value to the control unit 11.

Figure 12:
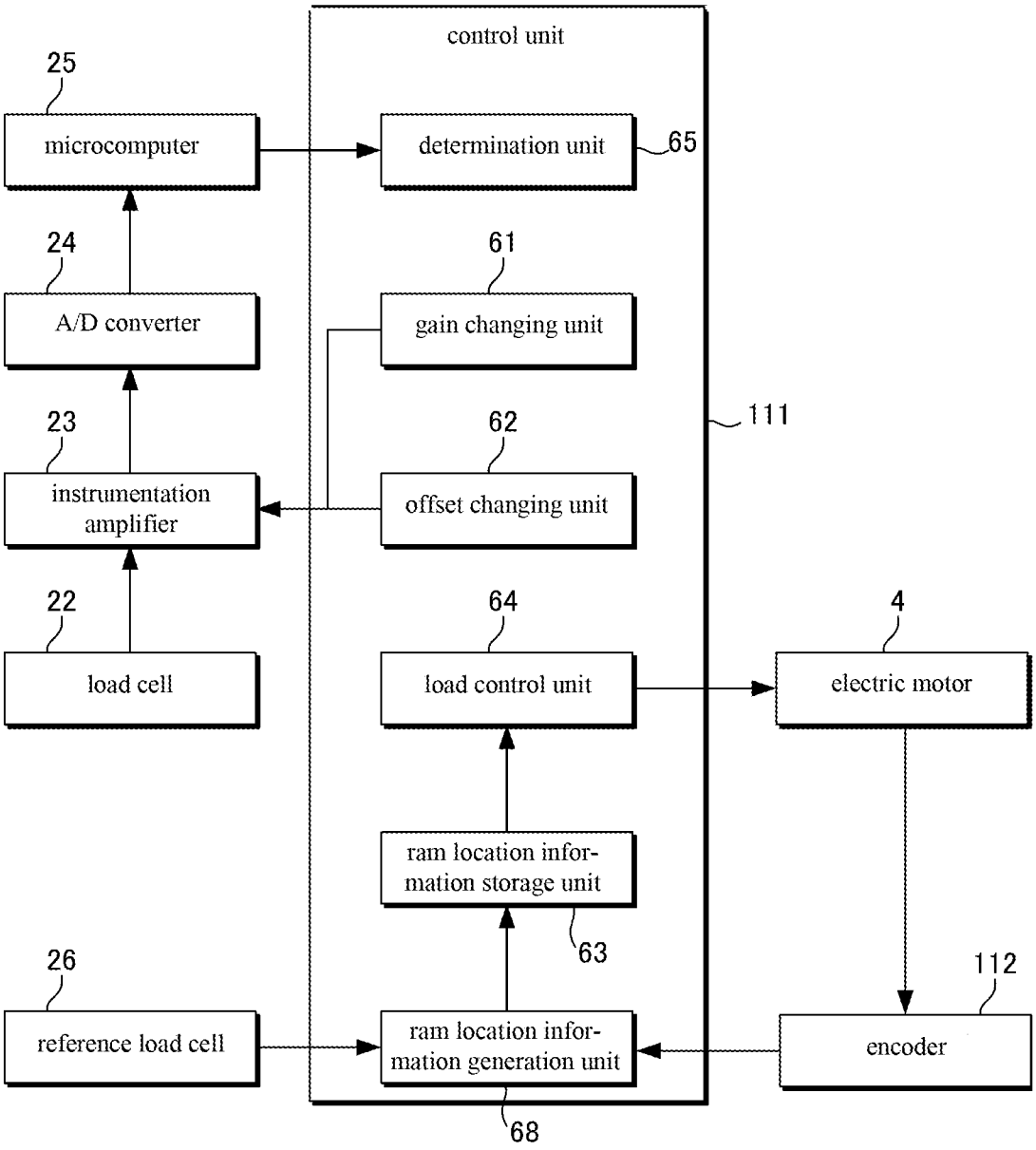
FIG. 12 is a block diagram showing the functional configuration of a control unit according to the third embodiment.

As shown in FIG. 12, the control unit 111 includes a ram location information generation unit 68 by the execution of a calibration program. The ram location information generation unit 68 is configured to chiefly include a computation control device 114, and functions to generate ram location information and stores the generated ram location information in a ram location information storage unit 63. The ram location information generation unit 68 acquires the location information of a ram 3 from an encoder 112. Furthermore, the ram location information generation unit 68 acquires the load value from the reference load cell 26. The ram location information generation unit 68 generates ram location information by combining the location information of the ram 3 and the load value that are acquired at the same time.

In the electric press 10, after the ram location information has been generated by the reference load cell 26 and the ram location information generation unit 68, the calibration of the instrumentation amplifier 23 is performed. There is a case where a difference occurs between ram location information stored when the electric press 10 is installed, i.e., correlations between the locations of the ram 3 and loads when the electric press 10 is installed, and correlations between the locations of the ram 3 and loads when the calibration is performed. For example, there may be a case where there is a difference in the size of a workpiece W or the magnitude of a spring coefficient used for the calibration, where a ball screw 31 is worn, or where a strain column 2 is worn.

In the electric press 10, even when a calibration environment becomes different from that of a previous round and there is a change in the correlations between the locations of the ram 3 and loads, highly accurate calibration can be achieved. In particular, when the instrumentation amplifier 23 is maintained and repaired in the state in which the electric press 10 has been installed, a desirable effect can be achieved.

(Fourth Embodiment)

An electric press 10 according to a fourth embodiment of the present invention will be described in detail below with reference to the accompanying drawings. The same reference symbols will be assigned to components and functions that are the same as those of the first to third embodiments, and detailed descriptions thereof will be omitted.

Figure 13:
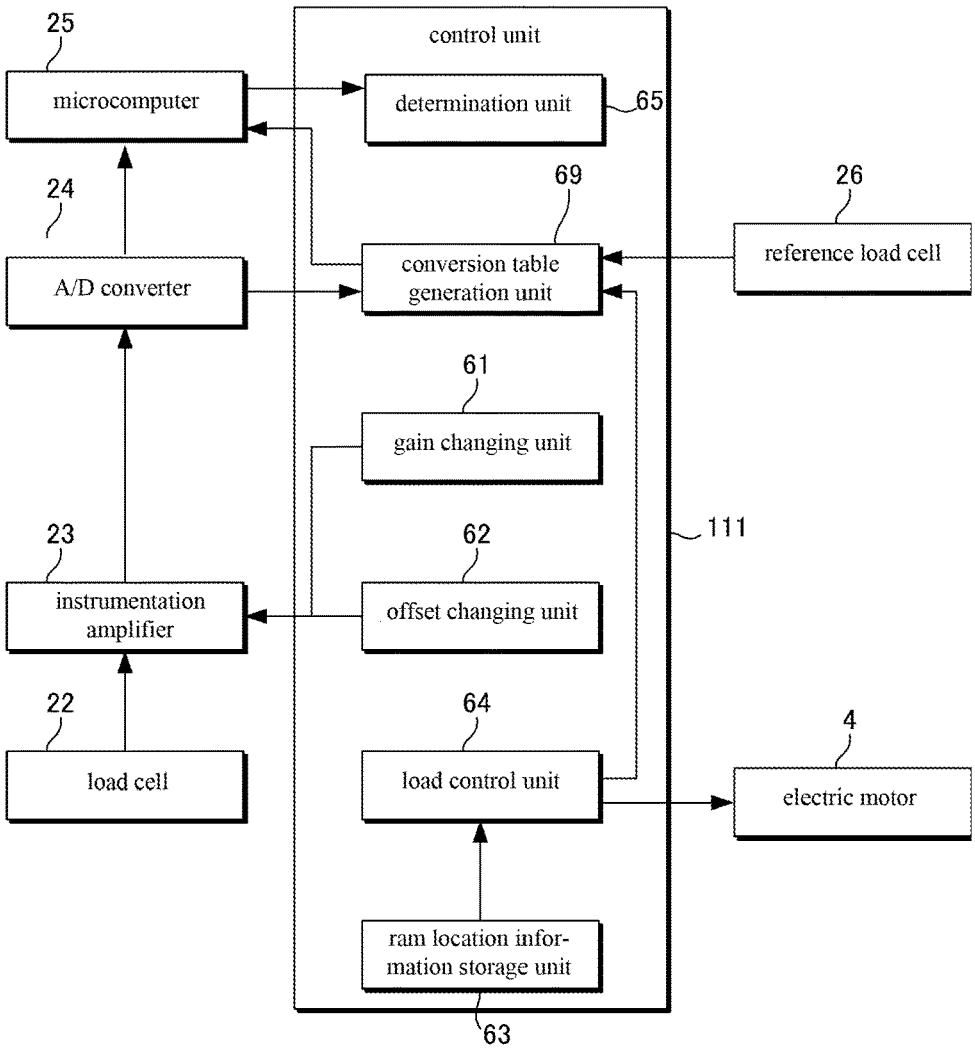
FIG. 13 is a block diagram showing the functional configuration of a control unit according to a fourth embodiment.

As shown in FIG. 13, a control unit 111 includes a conversion table generation unit 69 by the execution of a calibration program. The conversion table generation unit 69 is configured to chiefly include a computation control device 114, and generates a conversion table adapted to associate amplified values converted into digital values with load values processed by the control unit 11.

Figure 14:
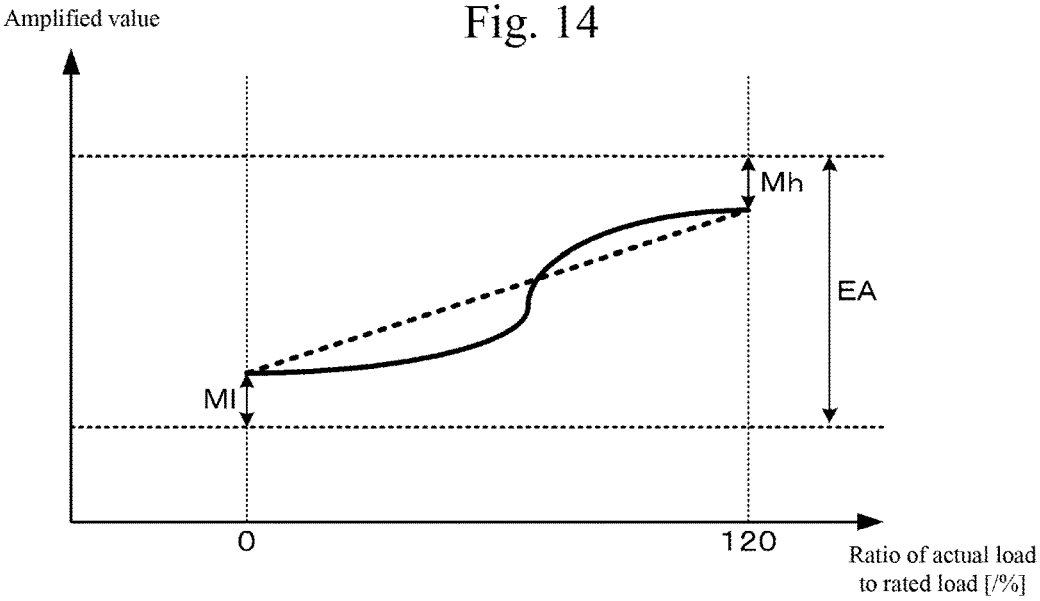
FIG. 14 is a graph plotting correlations between appropriate actual loads and values passed through a load cell.

Furthermore, the conversion table generation unit 69 updates the conversion table in response to changes in gain and offset values or a change in a load cell 22 over time. The reason for this is that a load represented by the same amplified value before calibration becomes different from a load represented by the same amplified value after the calibration due to changes in gain and offset values set for an instrumentation amplifier 23. Furthermore, there is nonlinearity between the output values of the load cell 22 and actual loads, as shown in FIG. 14, and thus correlations between all the output values and all the actual loads are not changed equally.

Figure 15:
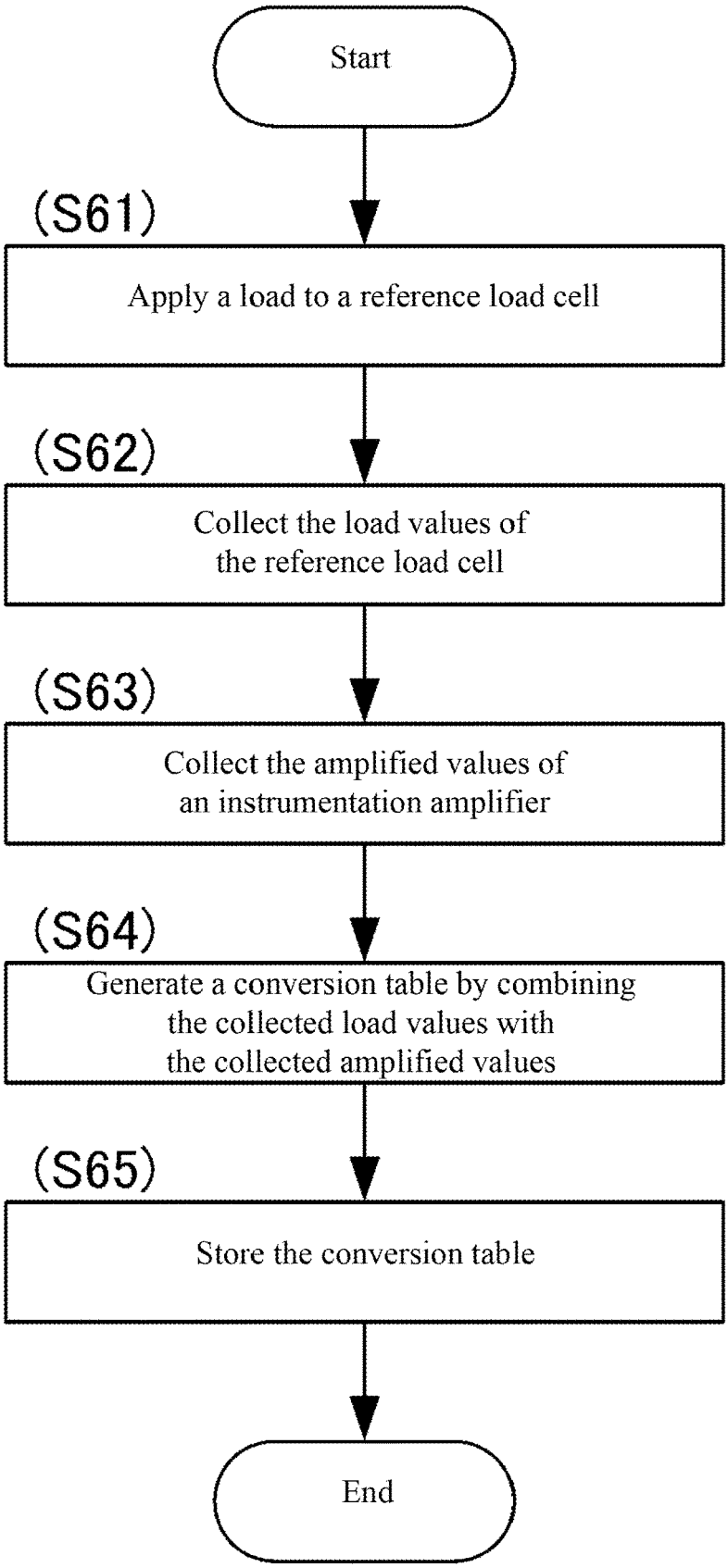
FIG. 15 is a flowchart showing the conversion table generation operation of a conversion table generation unit.

As shown in FIG. 15, the conversion table generation unit 69 applies a load to a reference load cell 26 installed in place of a workpiece W at step S61, acquires a load value output by the reference load cell 26 at step S62, and acquires a digital amplified value generated on the electric press side at step S63. Furthermore, the conversion table generation unit 69 generates a conversion table adapted to pair load values of the reference load cell 26 with corresponding digital amplified values for respective loads at step S64, and stores the generated conversion table in the conversion table storage unit 251 of the microcomputer 25 at step S65.

Figure 16:
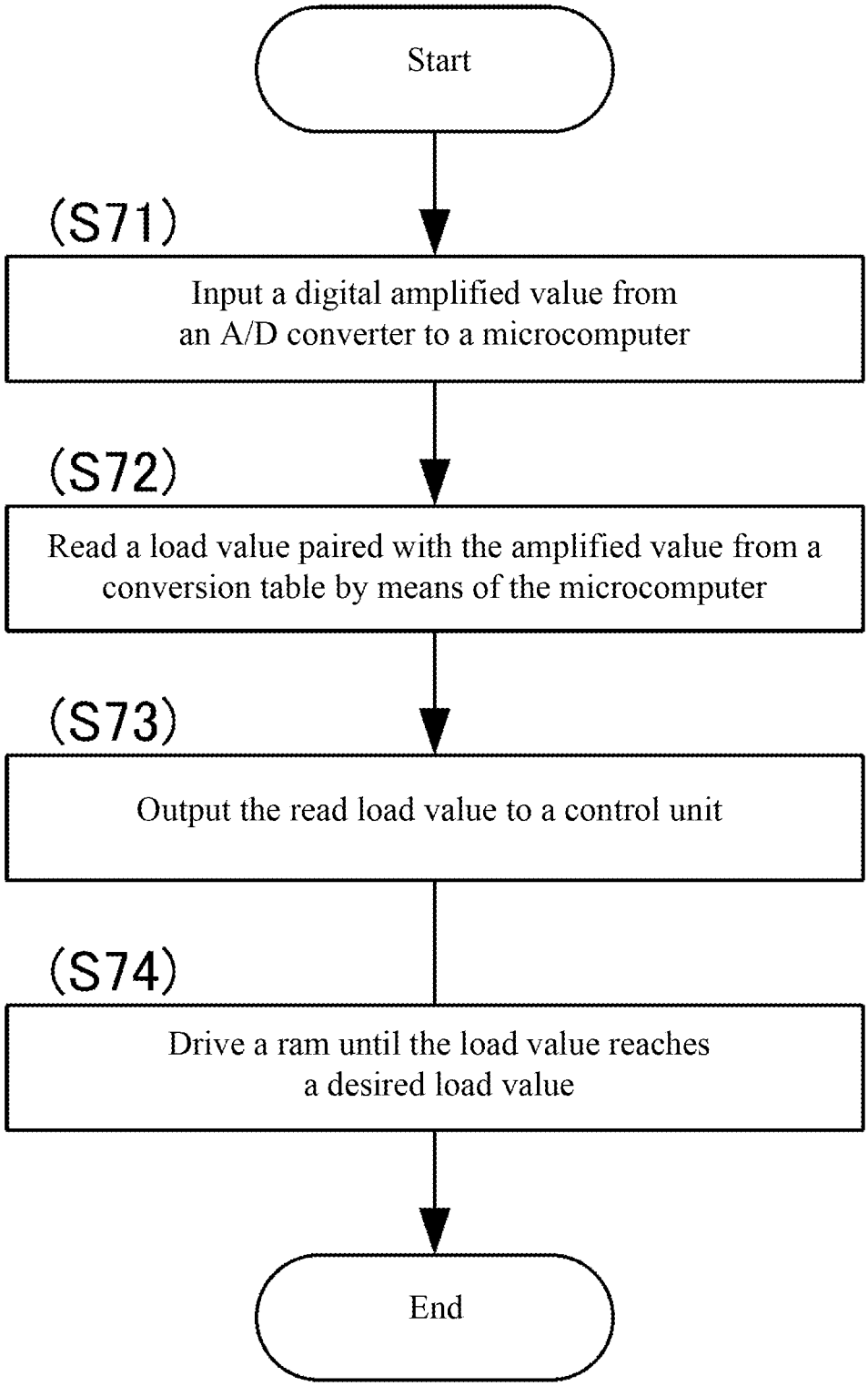
FIG. 16 is a flowchart showing the load value generation operation of a load value generation unit.

As shown in FIG. 16, when a digital amplified value is input from the A/D converter 24 at step S71, the load value generation unit 252 reads the load value of the reference load cell 26, paired with the amplified value, from the conversion table at step S72. The load value generation unit 252 outputs the read load value to the control unit 11 in place of the input amplified value at step S73. The control unit 11 drives the ram 3 until the read load value reaches a desired load value at step S74.

Furthermore, the conversion table generation unit 69 does not need to collect correlations between digital amplified values and load values for continuous values ranging from 0% to 120% of a rated load. The conversion table generation unit 69 acquires, for example, discrete values for 20%, 40%, 60%, 80%, 100% and 120% of the rated load, and arranges the discrete values in a conversion table. Furthermore, the conversion table generation unit 69 interpolates a correlation between a digital amplified value and a load value absent in the conversion table by using an interpolation method or the like. This interpolation may be performed when the conversion table is updated, or may be performed in the case where a corresponding correlation is absent in the conversion table when the workpiece W is machined.

As described above, the electric press 10 is configured to change a correlation between a load value and an amplified value contained in the conversion table stored by the conversion table storage unit 251 when the ram 3 has been moved based on ram location information. Accordingly, even when the conversion table is calibrated, the overshoot of the ram 3 is suppressed in the same manner, and thus the ram 3 can be rapidly moved and a correlation between an amplified value and a load value can be acquired. Therefore, a calibration operation can be rapidly performed, and thus the manufacturing efficiency of workpiece W can be improved.

Furthermore, a correlation between an amplified value and a load value that is not measured by a calibration operation is generated by interpolation based on the correlations between the amplified values and the load values present in the conversion table. Accordingly, since correlations between large numbers of amplified values and load values do not need to be measured, the calibration operation can be rapidly performed and the chance of the overshoot of the ram 3 can be reduced.

(Fifth Embodiment)

An electric press according to a fifth embodiment of the present invention will be described in detail below with reference to the accompanying drawings. The same reference symbols will be assigned to components and functions that are the same as those of the first to fourth embodiments, and detailed descriptions thereof will be omitted.

Figure 17:
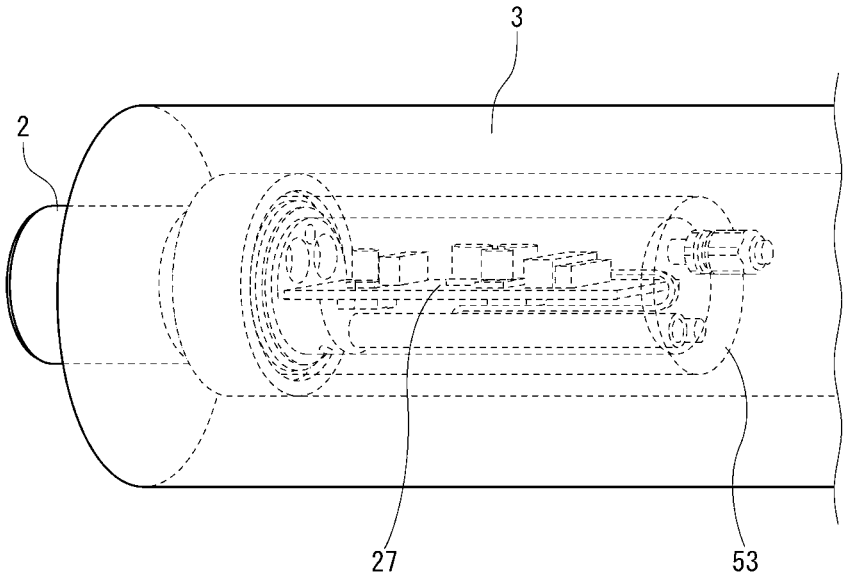
FIG. 17 is a sectional view showing the front end portion of a ram including a strain column according to a fifth embodiment.

FIG. 17 is a sectional view showing the front end portion of a ram 3 including a strain column 2 according to the fifth embodiment. As shown in FIG. 17, an amplifier circuit board 27 is accommodated inside the hollow portion of the ram 3 in addition to a ball screw 31. The amplifier circuit board 27 is accommodated in a resin cover 53 and then installed inside the ram 3. The resin cover 53 seals the amplifier circuit board 27, and prevents the erroneous operation of the amplifier circuit board 27 attributable to the adhesion of the grease or oil component of grease of the ball screw 31.

Figure 18:
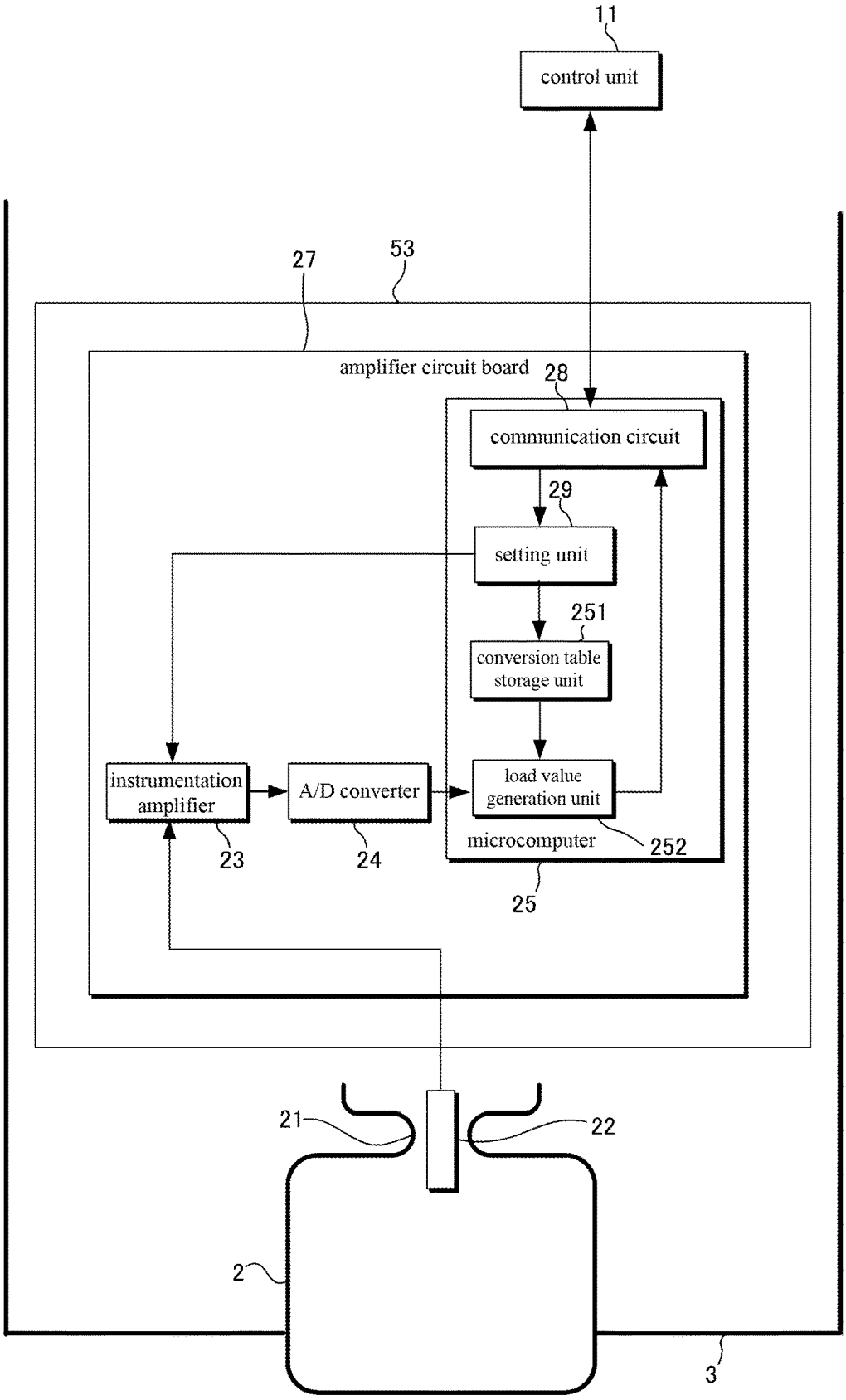
FIG. 18 is a block diagram showing the configuration of an amplifier circuit board.
Figure 19:
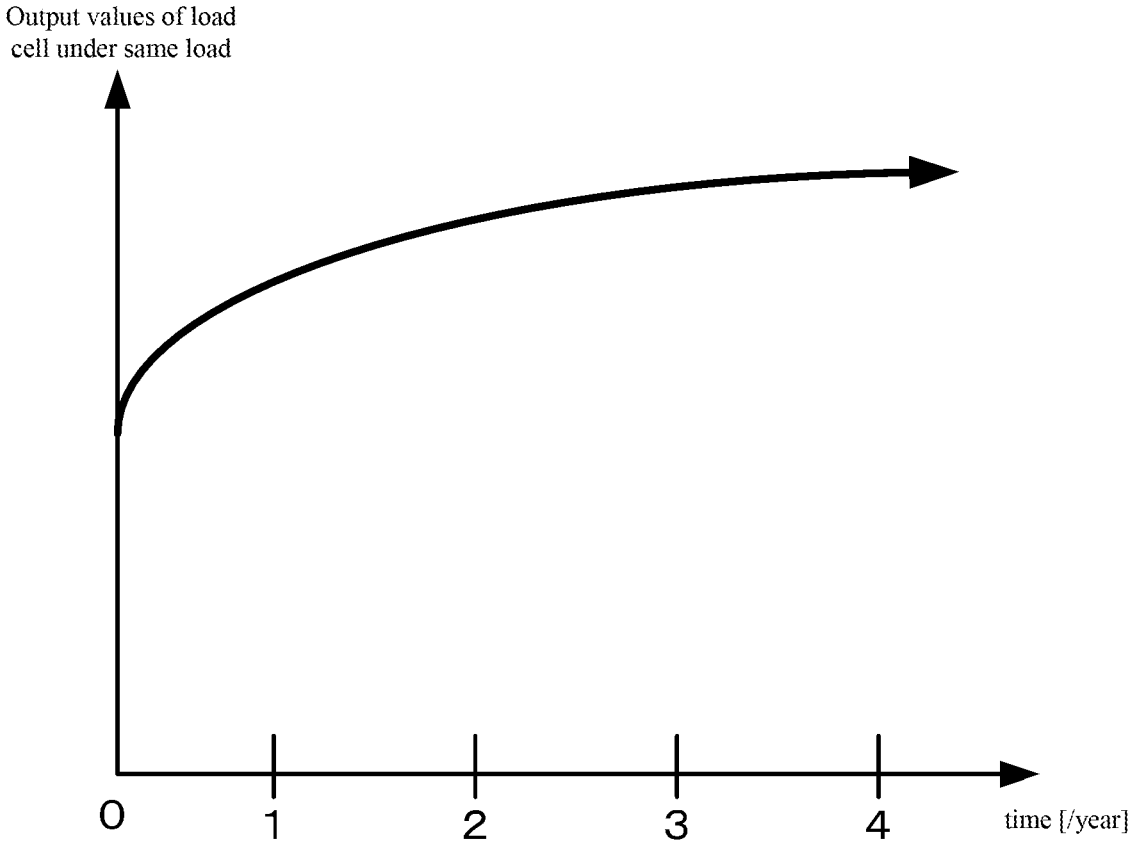
FIG. 19 is a graph showing changes in the output value of a load cell over time.

As shown in FIG. 18, an instrumentation amplifier 23, an A/D converter 24, and a microcomputer 25 are mounted on the amplifier circuit board 27. A communication circuit 28 and a setting unit 29 are mounted on the microcomputer 25 in addition to a conversion table storage unit 251 and a load value generation unit 252.

The communication circuit 28 is, for example, a communication integrated circuit (IC) based on RS485, and functions to output a load value to a control unit 11 via a signal line and to receive control signals from the gain changing unit 61 and offset changing unit 62 of the control unit 11. The control signal includes data indicative of gain and offset values.

The setting unit 29 receives the control signals received by the communication circuit 28 from the gain changing unit 61 and offset changing unit 62 of the control unit 11, and sets the gain and offset values for the instrumentation amplifier 23 in response to the control signals. Furthermore, the setting unit 29 receives a control signal, including a conversion table, from the control unit 11 via the communication circuit 28, and stores the conversion table in the conversion table storage unit 251.

The electric press 10 accommodates the amplifier circuit board 27 in the hollow portion of the ram 3, thereby reducing the distance between the load cell 22 and the instrumentation amplifier 23. That is, a signal line between the load cell 22 and the instrumentation amplifier 23 is reduced, and thus the degradation of signal-to-noise (S/N) ratio attributable to the inclusion of great noise in the low output value of the load cell 22 is suppressed.

To maximally reduce the signal line between the load cell 22 and the instrumentation amplifier 23, it is preferable to dispose the amplifier circuit board 27 as close to the load cell 22 as possible. The electric press 10 reduces the distance between a strain column 2 and the instrumentation amplifier 23 in such a manner that the resin cover 53 is fastened to the rear end of the strain column 2 and the resin cover 53 accommodating the strain column 2 and the amplifier circuit board 27 is integrated into a unit.

In this case, when the instrumentation amplifier 23 is accommodated inside the ram 3 in order to prevent the S/N ratio of a load value from being degraded, an operation of applying a load to a compression target during a calibration operation may cause a risk to an operator. Meanwhile, when the instrumentation amplifier 23 is disposed to be spaced apart from the electric press 10 in order to avoid the above risk, the S/N ratio of the load value may be degraded.

In contrast, in the electric press 10, the instrumentation amplifier 23 is disposed close to the load cell 22, and the communication circuit 28 and the setting unit 29 are disposed close to the instrumentation amplifier 23, thereby reconciling the suppression of the degradation of the S/N ratio with the avoidance of the risk to an operator.

(Other Embodiments)

While the embodiments of the present invention have been described above, various omissions, substitutions and variations may be made within a range that does not apart from the gist of the present invention. Furthermore, these embodiments or modifications are included in the scope or gist of the present invention or ranges equivalent to the inventions described in the following claims.

For example, the functions of the conversion table storage unit 251 and load value generation unit 252 of the microcomputer 25 may be performed by the control unit 111.

According to the present invention, even when the ram is moved at high speed during a calibration operation, a great overshoot occurs rarely, and thus the high-speed movement of the ram is realized, thereby reducing calibration operation time.

Note that, this invention is not limited to the above-mentioned embodiments. Although it is to those skilled in the art, the following are disclosed as the one embodiment of this invention.

Mutually substitutable members, configurations, etc. disclosed in the embodiment can be used with their combination altered appropriately.

Although not disclosed in the embodiment, members, configurations, etc. that belong to the known technology and can be substituted with the members, the configurations, etc. disclosed in the embodiment can be appropriately substituted or are used by altering their combination.

Although not disclosed in the embodiment, members, configurations, etc. that those skilled in the art can consider as substitutions of the members, the configurations, etc. disclosed in the embodiment are substituted with the above mentioned appropriately or are used by altering its combination.

While the invention has been particularly shown and described with respect to preferred embodiments thereof, it should be understood by those skilled in the art that the foregoing and other changes in form and detail may be made therein without departing from the sprit and scope of the invention as defined in the appended claims.

What is claimed is:

1. An electric press for applying a load to a compression target by means of an electrically-driven ram, the electric press comprising:

a detection unit configured to detect a load value applied to the compression target; and a control unit configured to control the ram based on the load value of the detection unit and calibrate the load value;

wherein the control unit configured to calibrate the load value includes:

a ram location information storage unit configured to store ram location information, corresponding to actual load values and representing locations to which the ram is moved, in advance; and a load control unit configured to apply an actual load, corresponding to at least one location which belongs to the locations represented by the ram location information and to which the ram is moved, to the compression target by moving the ram to the location; and wherein the control unit configured to calibrate the load value calibrates the load value, output by the detection unit, based on the actual load value applied to the compression target.

2. The electric press of claim 1, wherein:

the detection unit includes a load cell and an instrumentation amplifier, and detects the load value through a process of amplifying the output value of the load cell by means of the instrumentation amplifier; and the control unit changes gain and offset values of the instrumentation amplifier.

3. The electric press of claim 1, wherein:

the detection unit includes a load cell, an instrumentation amplifier, and a load value generation unit having a conversion table representing correlations between amplified values of the instrumentation amplifier and load values, and detects the load value through a conversion process of converting an amplified value, output by the instrumentation amplifier, into the load value; and the control unit changes the values or correlations of the conversion table.

4. The electric press of claim 3, wherein during the calibration or during machining of the compression target, the control unit generates a correlation between the amplified value and the load value absent in the conversion table through interpolation based on the correlations between the amplified values and the load values present in the conversion table.

5. The electric press of claim 1, wherein the detection unit comprises:

a strain element configured to come into contact with the compression target;

a load cell configured to detect distortion of the strain element;

an instrumentation amplifier installed inside the ram, and configured to amplify the output value of the load cell;

a setting unit installed inside the ram, and configured to set gain and offset values for the instrumentation amplifier; and a communication unit installed inside the ram, and configured to receive a control signal indicative of the gain and offset values from the control unit;

wherein the control unit transmits the control signal including the gain and offset values to the communication unit in order to calibrate the load value; and wherein the setting unit sets the gain and offset values for the instrumentation amplifier in accordance with the control signal received via the communication unit.

* * * * *